US008924199B2

(12) United States Patent
Ishikawa et al.

(10) Patent No.: US 8,924,199 B2
(45) Date of Patent: Dec. 30, 2014

(54) VOICE CORRECTION DEVICE, VOICE CORRECTION METHOD, AND RECORDING MEDIUM STORING VOICE CORRECTION PROGRAM

(75) Inventors: Chisato Ishikawa, Kawasaki (JP); Takeshi Otani, Kawasaki (JP); Taro Togawa, Kawasaki (JP); Masanao Suzuki, Kawasaki (JP); Masakiyo Tanaka, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 382 days.

(21) Appl. No.: 13/331,209

(22) Filed: Dec. 20, 2011

(65) Prior Publication Data

US 2012/0197634 A1 Aug. 2, 2012

(30) Foreign Application Priority Data

Jan. 28, 2011 (JP) ..... 2011-016808
Jul. 27, 2011 (JP) ..... 2011-164828

(51) Int. Cl.

| | |
|---|---|
| ***G10L 19/00*** | (2013.01) |
| ***G10L 21/043*** | (2013.01) |
| ***G10L 21/0364*** | (2013.01) |
| ***G10L 21/057*** | (2013.01) |
| *G10L 25/90* | (2013.01) |
| *G10L 25/84* | (2013.01) |

(52) U.S. Cl.

CPC ..... *G10L 21/043* (2013.01); *G10L 21/0364* (2013.01); *G10L 21/057* (2013.01); *G10L 25/90* (2013.01); *G10L 25/84* (2013.01)

USPC ..... 704/201; 704/202; 704/204; 704/226; 704/227; 704/228

(58) Field of Classification Search

USPC ..... 704/201–206, 226–228

See application file for complete search history.

(56) References Cited

U.S. PATENT DOCUMENTS

| | | | | |
|---|---|---|---|---|
| 5,991,724 | A * | 11/1999 | Kojima et al. | 704/266 |
| 2004/0088161 | A1 * | 5/2004 | Corrigan et al. | 704/211 |
| 2005/0119889 | A1 * | 6/2005 | Yamazaki | 704/259 |
| 2007/0276662 | A1 | 11/2007 | Akamine et al. | |
| 2011/0196678 | A1 * | 8/2011 | Hanazawa | 704/251 |

FOREIGN PATENT DOCUMENTS

| | | |
|---|---|---|
| JP | 05-027792 | 2/1993 |
| JP | 07-066767 | 3/1995 |
| JP | 08-163212 | 6/1996 |
| JP | 11-311676 | 11/1999 |
| JP | 3619946 | 11/2004 |
| JP | 2007-004356 | 1/2007 |
| JP | 2007-279349 | 10/2007 |
| JP | 2008-278327 | 11/2008 |
| JP | 2009-229932 | 10/2009 |

* cited by examiner

*Primary Examiner* — Leonard Saint Cyr
(74) *Attorney, Agent, or Firm* — Staas & Halsey LLP

(57) ABSTRACT

A voice correction device includes a detector that detects a response from a user, a calculator that calculates an acoustic characteristic amount of an input voice signal, an analyzer that outputs an acoustic characteristic amount of a predetermined amount when having acquired a response signal due to the response from the detector, a storage unit that stores the acoustic characteristic amount output by the analyzer, a controller that calculates an correction amount of the voice signal on the basis of a result of a comparison between the acoustic characteristic amount calculated by the calculator and the acoustic characteristic amount stored in the storage unit, and a correction unit that corrects the voice signal on the basis of the correction amount calculated by the controller.

14 Claims, 30 Drawing Sheets

| No | VOICE LEVEL | RANGE |
|---|---|---|
| 1 | 10 dB | +3<br>-10 |
| 2 | ••• | |

| VOICE LEVEL OF OUTPUT SOUND | AMBIENT NOISE LEVEL | PRESENCE OR ABSENCE OF RESPONSE |
|---|---|---|
| S2 | N1 | PRESENCE |
| S2 | N1 | PRESENCE |
| S3 | N2 | PRESENCE |
| S3 | N2 | PRESENCE |
| S2 | N2 | ABSENCE |
| S2 | N2 | ABSENCE |
| S2 | N1 | ABSENCE |
| S2 | N1 | PRESENCE |
| S1 | N1 | ABSENCE |

FIG. 21

| VOICE LEVEL OF OUTPUT SOUND | AMBIENT NOISE LEVEL | PRESENCE OR ABSENCE OF RESPONSE |
|---|---|---|
| S2 | N1 | PRESENCE |
| S2 | N1 | PRESENCE |
| S2 | N1 | ABSENCE |
| S2 | N1 | PRESENCE |
| S1 | N1 | ABSENCE |

FIG. 25

| | | < AMBIENT NOISE LEVEL RANK, SNR RANK > | | |
|---|---|---|---|---|
| | | < 1, 1 > | < Rn, 1 > | < Rn, Rsnr > |
| VOICE LEVEL RANK | 1 | PRESENCE (* NUMBER), ABSENCE (* NUMBER) | PRESENCE (* NUMBER), ABSENCE (* NUMBER) | PRESENCE (* NUMBER), ABSENCE (* NUMBER) |
| | 2 | PRESENCE (* NUMBER), ABSENCE (* NUMBER) | PRESENCE (* NUMBER), ABSENCE (* NUMBER) | PRESENCE (* NUMBER), ABSENCE (* NUMBER) |
| | Rs | PRESENCE (* NUMBER), ABSENCE (* NUMBER) | PRESENCE (* NUMBER), ABSENCE (* NUMBER) | PRESENCE (* NUMBER), ABSENCE (* NUMBER) |

FIG. 26

| | | AMBIENT NOISE LEVEL RANK | | |
|---|---|---|---|---|
| | | 1 | 2 | Rn |
| SNR RANK | 1 | o (< 1, 1 >) | o (< 2, 1 >) | o (< Rn, 1 >) |
| | 2 | o (< 1, 2 >) | o (< 2, 2 >) | o (< Rn, 2 >) |
| | Rsnr | o (< 1, Rsnr >) | o (< 2, Rsnr >) | o (< Rn, Rsnr >) |

FIG. 29

| | | SPEAKING SPEED RANK | | |
|---|---|---|---|---|
| | | 1 | 2 | 10 |
| FUNDAMENTAL FREQUENCY RANK | 1 | INTELLIGIBILITY p ( 1, 1 ) | INTELLIGIBILITY p ( 2, 1 ) | INTELLIGIBILITY p ( 10, 1 ) |
| | 2 | INTELLIGIBILITY p ( 1, 2 ) | INTELLIGIBILITY p ( 2, 2 ) | INTELLIGIBILITY p ( 10, 2 ) |
| | 10 | INTELLIGIBILITY p ( 1, 10 ) | INTELLIGIBILITY p ( 2, 10 ) | INTELLIGIBILITY p ( 10, 10 ) |

FIG. 30

| | | |
|---|---|---|
| FUNDAMENTAL FREQUENCY RANK | 1 | TARGET CORRECTION AMOUNT o ( 1 ) |
| | 2 | TARGET CORRECTION AMOUNT o ( 2 ) |
| | 10 | TARGET CORRECTION AMOUNT o ( 10 ) |

VOICE CORRECTION DEVICE, VOICE CORRECTION METHOD, AND RECORDING MEDIUM STORING VOICE CORRECTION PROGRAM

CROSS-REFERENCE TO RELATED APPLICATIONS

This application is based upon and claims the benefit of priority of the prior Japanese Patent Application No. 2011-016808, filed on Jan. 28, 2011, and the Japanese Patent Application No. 2011-164828, filed on Jul. 27, 2011, the entire contents of which are incorporated herein by reference.

FIELD

The embodiments discussed herein are related to a voice correction device, a voice correction method, and a voice correction program, each of which corrects an input sound.

BACKGROUND

There has been a voice correction device that performs correction for causing a voice to be easily heard when it is determined that asking in reply from a user is included in a conversation.

In addition, there has been a voice correction device of the related art that includes a keyword detection unit detecting an enhanced word to be important from an input voice, an enhancement processing unit subjecting the detected enhanced word to enhancement processing, and a voice-output unit converting the input voice into a word subjected to the enhancement processing by the enhancement processing unit and voice-outputting the word.

In addition, in the preprocessing of voice recognition, there has been a technique in which the characteristics of a plurality of noises and enhancement amounts suitable for noises are preliminarily stored, the degree of attribution of the characteristic of a stored noise is calculated from the characteristic of an input sound, and the input sound is enhanced in accordance with the degree of attribution of the noise.

In addition, as another technique, there has been a technique in which a phrase for a user to hardly distinguish is extracted on the basis of a linguistic difference between the content of a recognition text recognized from an initial voice and the content of an input text and the extracted phrase is enhanced.

In addition, in mobile phone terminals, there has been a technique in which a plurality of single tone frequency signals are reproduced, a user listening to the reproduced signals inputs a listening result, and a voice is corrected on the basis of the listening result. In addition, in the mobile phone terminals, there has been a technique in which a transmitted sound is controlled so as to become small when received sound is small.

Examples of such techniques are disclosed in Japanese Laid-open Patent Publication No. 2007-4356, Japanese Laid-open Patent Publication No. 2008-278327, Japanese Laid-open Patent Publication No. 5-27792, Japanese Laid-open Patent Publication No. 2007-279349, Japanese Laid-open Patent Publication No. 2009-229932, Japanese Laid-open Patent Publication No. 7-66767, and Japanese Laid-open Patent Publication No. 8-163212.

SUMMARY

According to an aspect of the invention, A voice correction device includes a detector that detects a response from a user, a calculator that calculates an acoustic characteristic amount of an input voice signal, an analyzer that outputs an acoustic characteristic amount of a predetermined amount when having acquired a response signal due to the response from the detector, a storage unit that stores the acoustic characteristic amount output by the analyzer, a controller that calculates an correction amount of the voice signal on the basis of a result of a comparison between the acoustic characteristic amount calculated by the calculator and the acoustic characteristic amount stored in the storage unit, and a correction unit that corrects the voice signal on the basis of the correction amount calculated by the controller.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed

BRIEF DESCRIPTION OF DRAWINGS

FIG. 21 is a diagram illustrating an example of extracted input response history information;

FIG. 25 is a diagram illustrating an example of pieces of combination information with respect to ranks of a first acoustic characteristic amount and a second acoustic characteristic amount vector;

FIG. 26 is a diagram illustrating an example of a target correction amount in the sixth embodiment;

FIG. 29 is a diagram illustrating an example of intelligibility with respect to a fundamental frequency rank and a speaking speed rank;

FIG. 30 is a diagram illustrating an example of a target correction amount in the seventh embodiment;

DESCRIPTION OF EMBODIMENTS

In any one of the above-mentioned techniques of the related art, when being controlled, a voice is just controlled on the basis of a preliminarily defined amount, and control according to the audibility of a user has not been always performed, in some case.

Therefore, in the present embodiment, there is disclosed a technique providing a voice correction device, a voice correction method, and a voice correction program, each of which is capable of causing a voice to be easily heard in response to the audibility of a user, using a simple response.

Hereinafter, embodiments will be described in detail with reference to accompanying drawings.

First Embodiment

Block Diagram

Figure 1:
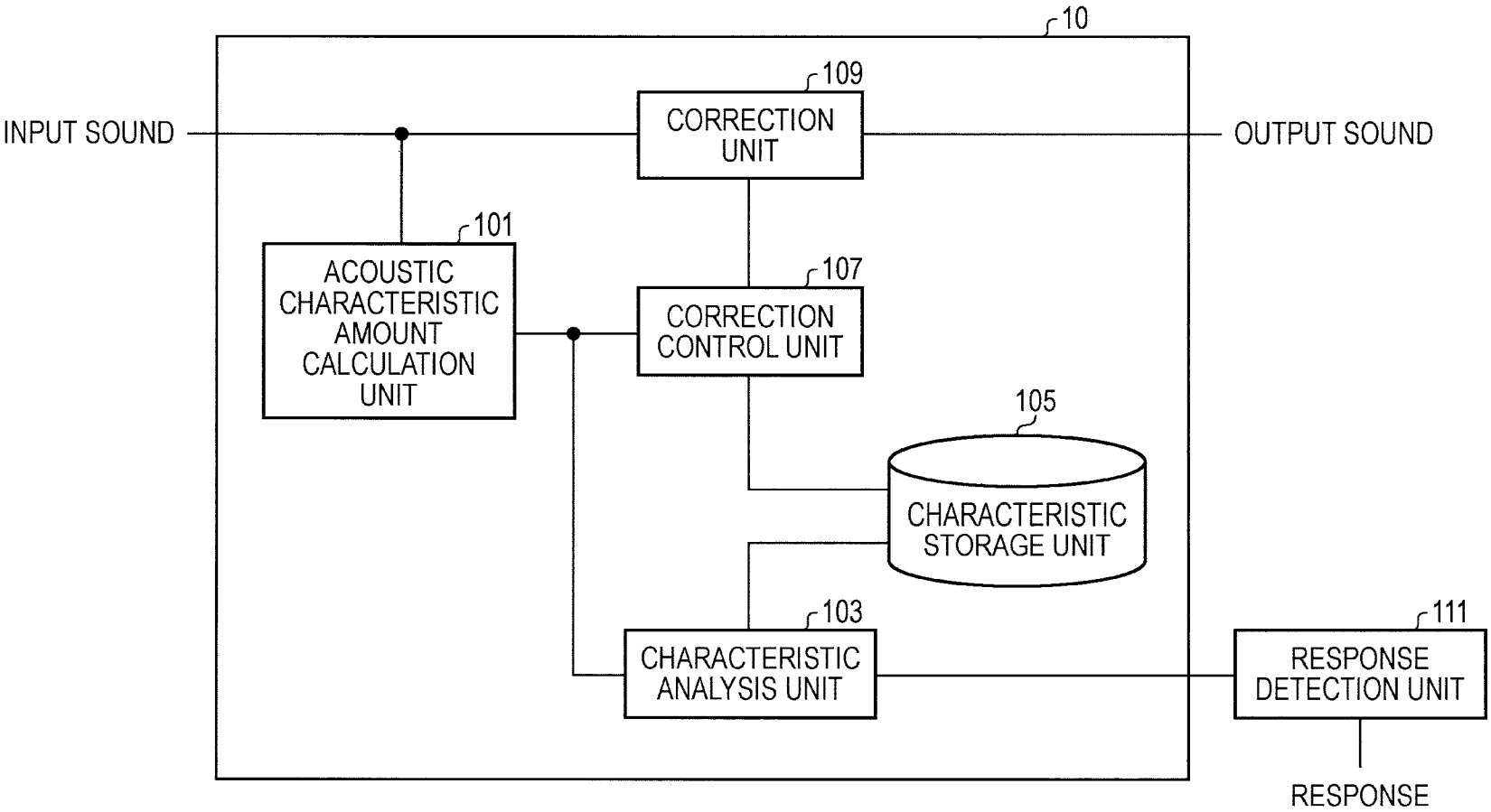
FIG. 1 is a block diagram illustrating an example of a configuration of a voice correction device in a first embodiment.

FIG. 1 is a block diagram illustrating an example of a voice correction device 10 in a first embodiment. The voice correction device 10 includes an acoustic characteristic amount calculation unit 101, a characteristic analysis unit 103, a characteristic storage unit 105, a correction control unit 107, and a correction unit 109. In addition, the voice correction device 10 may include a response detection unit 111 described later.

The acoustic characteristic amount calculation unit 101 acquires the voice signal of an input sound, and calculates an acoustic characteristic amount. Examples of the acoustic characteristic amount include the voice level of an input sound, the spectrum slope (slope) of the input sound, a difference between the power of the high frequency (for example, 2 to 4 kHz) of the input sound and the power of the low frequency (for example, 0 to 2 kHz) thereof, the fundamental frequency of the input sound, and the Signal to Noise ratio (SNR) of the input sound.

In addition to this, examples of the acoustic characteristic amount include the noise level of the input sound, the speaking speed of the input sound, the noise level of a reference sound (a sound input from a microphone), an SNR between the input sound and the reference sound (the voice level of the input sound/the noise level of the reference sound), and the like. It may be the acoustic characteristic amount calculation unit 101 to use one voice characteristic amount or a plurality of voice characteristic amounts from among the voice characteristic amounts described above. The acoustic characteristic amount calculation unit 101 outputs one calculated acoustic characteristic amount or a plurality of calculated acoustic characteristic amounts to the characteristic analysis unit 103 and the correction control unit 107.

The characteristic analysis unit 103 buffers the calculated latest acoustic characteristic amount of predetermined frames. When having acquired a response signal from the response detection unit 111, the characteristic analysis unit 103 outputs, as a defective acoustic characteristic amount, the acoustic characteristic amount of frames of predetermined amounts including a frame buffered at the time of the acquisition of the response signal, to the characteristic storage unit 105. The frame when the outputting to the characteristic storage unit 105 is performed may be a frame including the reception time of the response signal or a response time detected by the response detection unit 111 and included in the response signal. When a user has felt indistinctness to make a predetermined response and the response detection unit 111 has detected this response, the response signal from the response detection unit 111 is output.

In addition, the characteristic analysis unit 103 may include the acoustic characteristic amount calculation unit 101. In this case, the characteristic analysis unit 103 buffers the voice signal of the input sound of a predetermined length (for example, 10 frames). The characteristic analysis unit 103 calculates an acoustic characteristic amount on the basis of the voice signal of an analysis length from a time when the characteristic analysis unit 103 has acquired the response signal from the response detection unit 111. The characteristic analysis unit 103 outputs the calculated acoustic characteristic amount to the characteristic storage unit 105.

In addition, when not having acquired the response signal, the characteristic analysis unit 103 may calculate a statistic amount with regarding the buffered acoustic characteristic amount as a normal acoustic characteristic amount and store the calculated statistic amount in the characteristic storage unit 105. At this time, for example, the statistic amount of the normal acoustic characteristic amount is a frequency distribution (histogram) or a normal distribution. The characteristic analysis unit 103 calculates a frequency with respect to each acoustic characteristic amount of a predetermined unit, generates and updates a histogram based on the calculate frequency, and outputs the histogram to the characteristic storage unit 105.

In addition, when a plurality of different acoustic characteristic amounts is calculated, the characteristic analysis unit 103 performs the following processing. When there is no response signal, the characteristic analysis unit 103 updates the frequency distributions (for example, histograms) of the plural different acoustic characteristic amounts from the voice signal of a current frame.

When there is a response signal, the characteristic analysis unit 103 may calculate the plural different acoustic characteristic amounts from the voice signal of a predetermined number of frames including the current frame. The predetermined number of frames may include only the current frame, from the current frame to previous several frames, several frames before and after the current frame, or from the current frame to subsequent several frames. It may set a suitable value as the number of frames.

With respect to each of the plural calculated different acoustic characteristic amounts, the characteristic analysis unit 103 calculates a difference between the acoustic characteristic amount of the current frame or the average of the acoustic characteristic amounts of a predetermined number of frames and the average of a frequency distribution, and selects an acoustic characteristic amount where the calculated difference is the largest. This processing is a processing operation in which a defective acoustic characteristic amount most highly contributing to a factor for the determination of indistinctness is obtained. The characteristic analysis unit 103 registers the selected acoustic characteristic amount as the defective acoustic characteristic amount of the characteristic storage unit 105.

Figures 2A, 2B:
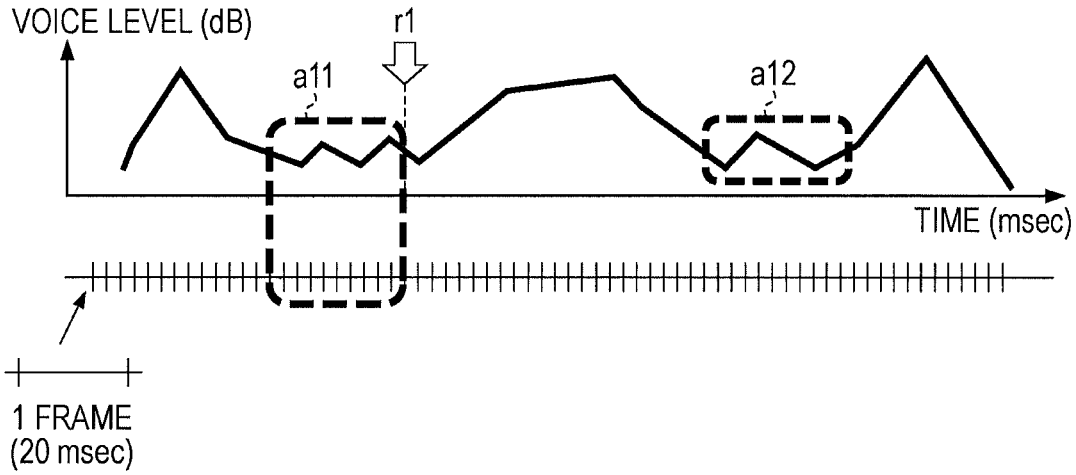
FIGS. 2A and 2B are diagrams for explaining an example of analysis processing.

Here, analysis processing when a voice level is defined as the acoustic characteristic amount will be described using an example. FIGS. 2A and 2B are diagrams for explaining an example of the analysis processing. FIG. 2A is a diagram illustrating a relationship between the voice level and a time. When having received a response signal from the response detection unit 111 at a timing of r1 illustrated in FIG. 2A, the characteristic analysis unit 103 stores, as defective voice levels, the voice levels of several previous frames before r1 (for example, 10 frames) (a11 illustrated in FIG. 2A) in the characteristic storage unit 105, for example. At this time, it may store the average of the voice levels of several frames, determined to be a defective acoustic characteristic amount, in the characteristic storage unit 105.

In addition, with respect to the timing of r1, since a user determines that the user has a hard time hearing, and it takes a predetermined time for the response signal to be output, it may compensate the time difference using a time constant. For example, a predetermined number of frames may be acquired with reference to a frame at several frames before the timing of r1.

FIG. 2B is a diagram illustrating an example of the data structure of a defective acoustic characteristic DB. In the DB illustrated in FIG. 2B, a registration number, a voice level, and a range are associated with one another. The registration number is incremented every time a defective acoustic characteristic amount is registered in the DB. The voice level is a defective voice level registered from the characteristic analysis unit 103. The defective voice level may be the average of the voice levels of a predetermined number of frames. The range indicates a range regarded to be defective, at the stage of the correction of a voice. For example, when the defective voice level is 10 dB, it is assumed that the range regarded to be defective is from 0 to 13 dB. The defective acoustic characteristic DB is output to the characteristic storage unit 105.

When, after the defective voice level has been stored, there is the interval of a voice level a12 illustrated in FIG. 2A, which is similar to the defective voice level, the correction amount of the voice level is determined by the correction control unit 107 described later. The correction unit 109 described later corrects a voice signal on the basis of the determined correction amount. Accordingly, an output voice is easily heard. With respect to the determination of whether or not the voice level is similar to the defective voice level, the correction control unit 107 may determine that it is a voice level, less than or equal to the defective voice level registered as a low voice level, to be corrected.

Returning to FIG. 1, the characteristic storage unit 105 stores therein a defective acoustic characteristic amount, and when there are a plurality of different acoustic characteristic amounts, the characteristic storage unit 105 stores therein a defective acoustic characteristic amount with respect to each acoustic characteristic amount. In addition, the characteristic storage unit 105 may also store the statistic amount of a normal acoustic characteristic amount, and when there is a plurality of different acoustic characteristic amounts, the characteristic storage unit 105 may also store a statistic amount with respect to each acoustic characteristic amount.

The correction control unit 107 acquires the acoustic characteristic amount calculated by the acoustic characteristic amount calculation unit 101, and compares the acquired acoustic characteristic amount with the defective acoustic characteristic amount stored in the characteristic amount storage unit 105, thereby determining whether or not correct it. For example, when the acoustic characteristic amount of the current frame is similar to the defective acoustic characteristic amount, the correction control unit 107 determines that corrects, and calculates a correction amount.

Figure 3:
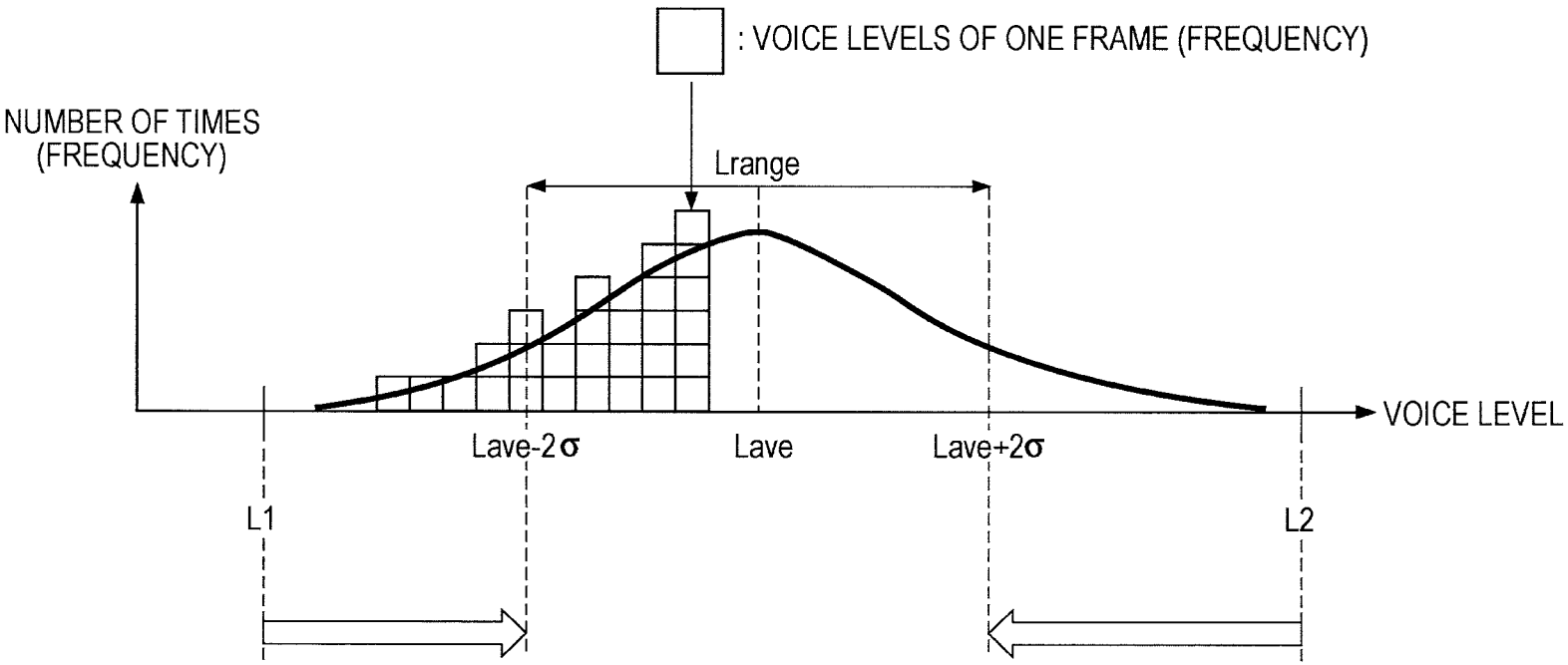
FIG. 3 is a diagram illustrating an example of a histogram of voice levels.

Hereinafter, the processing of correction control when the acoustic characteristic amount is the voice level will be described. It is assumed that the histogram of a normal voice level has been already stored in the characteristic storage unit 105. FIG. 3 is a diagram illustrating an example of the histogram of voice levels.

In addition, a case is illustrated in which a frequency distribution illustrated in FIG. 3 is a normal distribution (Gaussian distribution). Usually, since a speaker speaks so that the other person easily listens to the speaker, the frequency distribution of the voice level tends to be a frequency distribution similar to a normal distribution.

A Lave illustrated in FIG. 3 indicates the average value of a normal voice level. An Lrange indicates an interval easily heard, and indicates the range of $2\sigma$ from the average value Lave. L1 and L2 indicate the voice levels of frames at a time when a response occurs from a user. In the example illustrated in FIG. 3, for example, it is assumed that a frequency is calculated in each interval of 4 dB within from 0 to 40 dB.

For example, a case will be studied in which the user has felt indistinctness at the voice level of L1 and has made a predetermined response. At this time, the correction control unit 107 determines a correction amount so that the voice level L1 is within the range of the Lrange. For example, the correction control unit 107 defines $(Lave-2\sigma)-L1$ as the correction amount at the time of the voice level L1. The reason why the correction amount is set to $(Lave-2\sigma)-L1$ is that the correction amount is prevented from becoming too large. The correction amount determined by the correction control unit 107 is used in the correction unit 109, as an amplification amount.

In addition, it is assumed that the user has felt indistinctness at the voice level of L2 and has made a predetermined response. At this time, the correction control unit 107 determines a correction amount so that the voice level L2 is within the range of the Lrange. For example, the correction control unit 107 defines L2—(Lave+2σ) as the correction amount at the time of the voice level L2. The correction amount is used in the correction unit 109, as an attenuation amount.

Returning to FIG. 1, when the statistic amount of a normal acoustic characteristic amount is stored in the characteristic storage unit 105, the correction control unit 107 determines the correction amount, using the statistic amount of the normal acoustic characteristic amount. For example, the correction control unit 107 may determine the correction amount so that the defective acoustic characteristic amount is within a predetermined range including the average value of the normal acoustic characteristic amount. The correction control unit 107 outputs the determined correction amount to the correction unit 109.

On the basis of the correction amount acquired from the correction control unit 107, the correction unit 109 performs correction on an input voice signal. For example, when the correction amount is the amplification amount or the attenuation amount of the voice level, the correction unit 109 amplifies or attenuates the voice level of the voice signal by the correction amount.

In addition, the correction unit 109 corrects the voice signal in accordance with the acoustic characteristic amount corresponding to the correction amount. For example, when the correction amount is the gain of the voice level, the correction unit 109 increases or decreases the level of the voice signal, and when the correction amount is the speaking speed, the correction unit 109 performs speaking speed conversion. The correction unit 109 output the corrected voice signal.

The response detection unit 111 detects a response from the user, and outputs a response signal corresponding to the detected response to the characteristic analysis unit 103. For example, the response from the user means a predetermined response made by the user when the user has felt that it is hard to understand the output sound. An example of the response detection unit 111 will be illustrated as follows.

A key input sensor response detection unit 111 (key input sensor) detects that the existing key (for example, an output sound amount control button) of a mobile terminal or a new key (for example, a button newly provided and to be held down at the time of indistinctness) has been held down.

An acceleration sensor response detection unit 111 (acceleration sensor) detects a particular shock to a chassis. The particular shock means a double tap or the like.

An acoustic sensor response detection unit 111 (acoustic sensor) detects a preliminarily set keyword from a reference signal input by the microphone. In this case, the response detection unit 111 has stored therein the content of an utterance easily occurring when a person has trouble hearing. For example, the content of an utterance is "What?", "I can't hear you", "one more time", or the like.

A pressure sensor response detection unit 111 (pressure sensor) detects that an ear has been pressed to the chassis. This is because an ear tends to be pressed to the mobile phone at the time of the occurrence of indistinctness. At this time, the response detection unit 111 senses a pressure in the vicinity of a receiver.

It may be possible to make the above-mentioned response with an easy operation. This is because, for example, when it is assumed that a user is an elderly person, it is hard for the elderly person to perform complex operation. Therefore, according to the present embodiment and embodiments described later, it is possible to control a voice with an easy operation.

Hereinafter, the principles of the present embodiment and the embodiments described later will be described. First, the characteristic analysis unit 103 calculates and buffers an acoustic characteristic amount with respect to each frame. Here, the acoustic characteristic amount will be described with citing the voice level as an example.

(1) Case in which One Acoustic Characteristic Amount is Used (1-1) Learning of Defective Acoustic Characteristic Amount When a response occurs from a user, the voice level of an input sound of a predetermined analysis length starting from the response time of the user is registered, as a defective voice level, in the characteristic storage unit 105 on the basis of the response from the user. Every time a response occurs from the user, the defective voice level is registered in the characteristic storage unit 105.

(1-2) Correction of Voice

The correction control unit 107 compares a voice level calculated with respect to each frame with the defective voice level stored in the characteristic storage unit 105. When the input voice level is within the predetermined range of the defective voice level, a correction amount is determined.

As a method for determining the correction amount owing to the correction control unit 107, there are a method for settling on a preliminarily defined correction amount and a method for determining a correction amount in accordance with the audibility characteristic of the user. For example, in the method for settling on a preliminarily defined correction amount, the correction amount is preliminarily determined to be 10 dB.

In this regard, however, the preliminarily determined correction amount is not necessarily suitable for the audibility characteristic of the user. Accordingly, since the correction amount is determined in accordance with the audibility characteristic of the user, the correction control unit 107 determines the correction amount using the voice level of each frame other than when a response has occurred from the user.

Since that no response has occurred from the user means that the voice signal of the interval is a voice signal "able to be heard", the voice signal is sequentially stored as a normal voice level, and a frequency distribution is prepared.

If, using the frequency distribution, the correction control unit 107 determines the correction amount, it is possible to determine the correction amount "corresponding to the personal audibility characteristic of the user". As the correction amount, the correction control unit 107 determines the correction amount so that the voice level becomes the average value of the normal voice level, for example.

In addition, when a difference between the input voice and a corrected voice is taken into consideration, namely, when natural correction is taken into consideration, the correction control unit 107 may also determine the correction amount so that the input voice becomes a voice level of 2σ from the average value, for example. While, so far, a case has been described in which the voice level is cited as an example of the acoustic characteristic amount, even if the speaking speed or the like is cited as an example of the acoustic characteristic amount, it may be possible to apply the same processing.

(2) Case in which Plural Different Acoustic Characteristic Amounts are Used

Next, a case will be described in which a voice is corrected using a plurality of different acoustic characteristic amounts. Here, as examples of the plural different acoustic characteristic amounts, the voice level and the speaking speed will be described.

(2-1) Learning of Defective Acoustic Characteristic

When a response has occurred from a user, the voice level of an input sound of a predetermined analysis length starting from the response time of the user and the speaking speed of the input sound are registered, as a defective voice level and a defective speaking speed, in the characteristic storage unit 105 on the basis of the response from the user, respectively. Every time a response occurs from the user, the defective voice level and the defective speaking speed are registered in the characteristic storage unit 105.

In addition, when a response has occurred from the user, the characteristic analysis unit 103 selects at least one acoustic characteristic amount serving as a factor for indistinctness from among the plural different acoustic characteristic amounts, and registers the selected acoustic characteristic amount in the characteristic storage unit 105, as a defective acoustic characteristic amount. As a selection method, there is a method in which determination is performed using the average value of a normal acoustic characteristic amount.

For example, when a response has occurred from the user, the voice level and the speaking speed are individually calculated, and the characteristic analysis unit 103 selects one of the voice level and the speaking speed, which differs from the average value of the normal acoustic characteristic amount thereof.

Accordingly, while separating a case in which the sound volume of speaking is adequate and the speaking speed is high from a case in which the speaking speed is adequate and the sound volume of speaking is not adequate, the characteristic analysis unit 103 is able to register the defective acoustic characteristic amount.

(2-2) Correction of Voice

As for the correction of a voice, it may perform the processing described in (1-2) with respect to each of the plural different acoustic characteristic amounts.

<Operation>

Figure 4A:
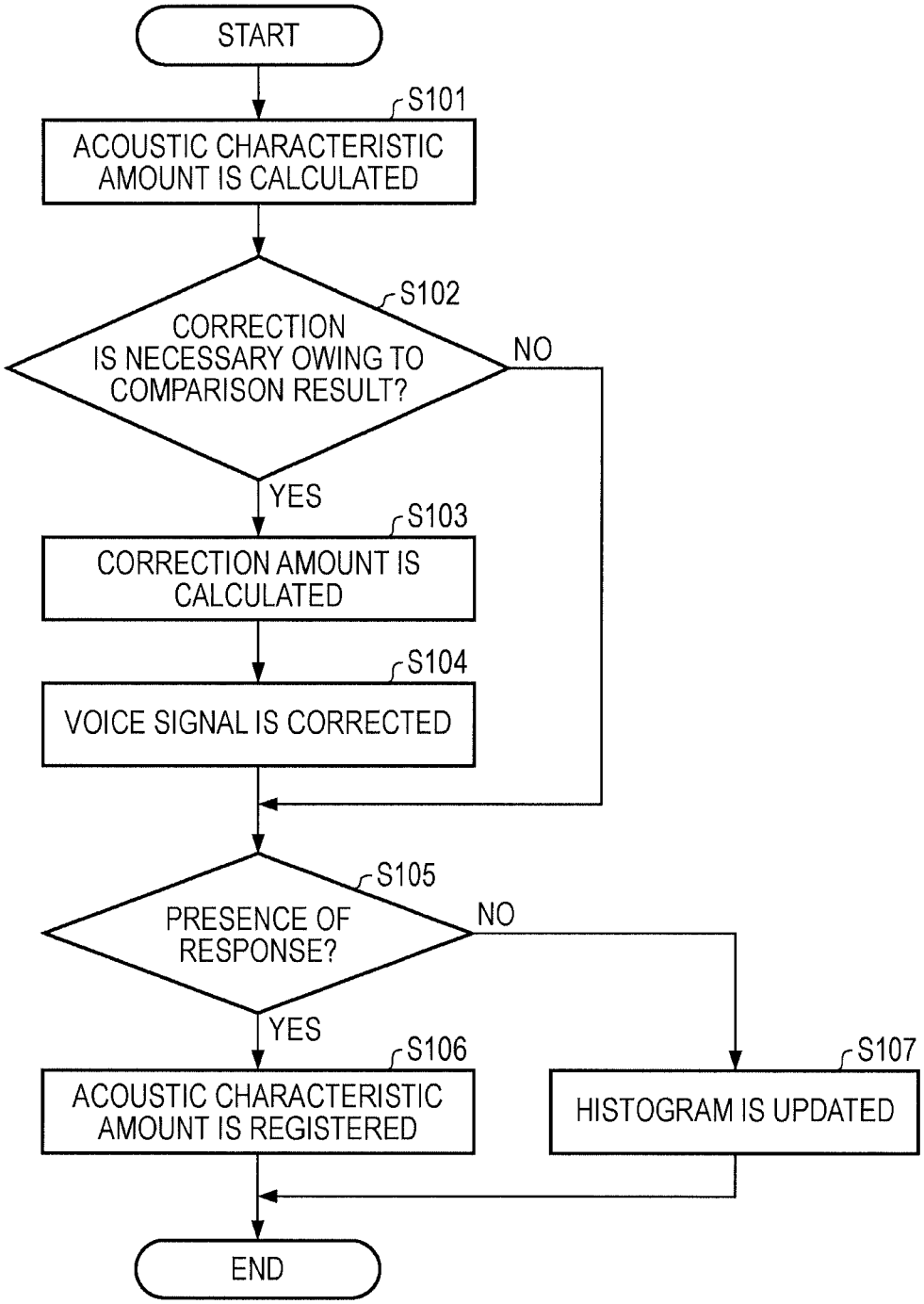
FIG. 4A is a flowchart illustrating an example of voice correction processing in the first embodiment.
Figure 4B:
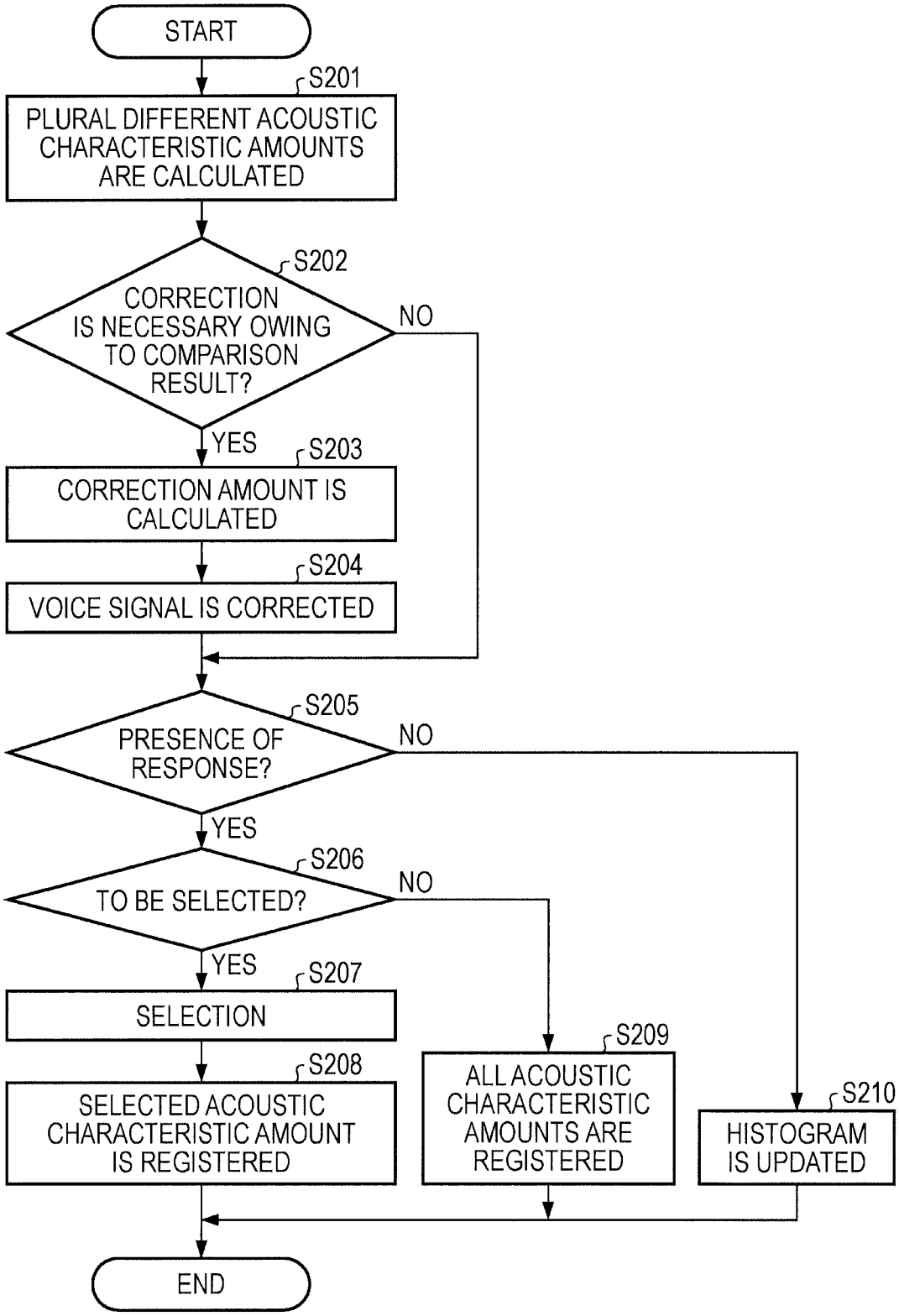
FIG. 4B is a flowchart illustrating an example of voice correction processing in the first embodiment.

Next, the operation of the voice correction device 10 in the first embodiment will be described. In the present embodiment, the operation of the voice correction device 10 in the first embodiment will be divided into a case in which one acoustic characteristic amount is calculated and a case in which a plurality of different acoustic characteristic amounts are calculated, and be described. FIGS. 4A and 4B are diagrams illustrating examples of voice correction processing operations in the first embodiment. The case in which one acoustic characteristic amount is used will be described in FIG. 4A, and the case in which the plural different acoustic characteristic amounts are used will be described in FIG. 4B.

(1) Case in which One Acoustic Characteristic Amount is Used

FIG. 4A is a flowchart illustrating an example of voice correction processing (1) in the first embodiment. In Step S101 illustrated in FIG. 4A, the acoustic characteristic amount calculation unit 101 calculates an acoustic characteristic amount (for example, the voice level) from an input voice signal.

In Step S102, the correction control unit 107 compares the calculated acoustic characteristic amount with a defective acoustic characteristic amount stored in the characteristic storage unit 105, and determines whether or not to perform correction. For example, when the calculated acoustic characteristic amount is within a predetermined range including the defective acoustic characteristic amount, it is determined that perform corrects (Step S102: YES), and the processing proceeds to a processing operation in Step S103. In addition, when the calculated acoustic characteristic amount is not within the predetermined range including the defective acoustic characteristic amount, it is determined that does not perform correction (Step S102: NO), and the processing proceeds to a processing operation in Step S105.

In Step S103, the correction control unit 107 calculates a correction amount using the normal acoustic characteristic amount stored in the characteristic storage unit 105. For example, the correction control unit 107 calculates the correction amount of the acoustic characteristic amount so that the acoustic characteristic amount is within a predetermined range including the average value of the normal acoustic characteristic amount.

In Step S104, the correction unit 109 corrects a voice signal on the basis of the correction amount calculated in the correction control unit 107.

In Step S105, the response detection unit 111 determines whether or not a response has occurred from a user. When the response occurs from the user (Step S105: YES), the processing proceeds to Step S106, and when no response occurs from the user (Step S105: NO), the processing proceeds to Step S107.

In Step S106, the characteristic analysis unit 103 registers the calculated acoustic characteristic amount as a defective acoustic characteristic amount to be stored in the characteristic storage unit 105.

In Step S107, the characteristic analysis unit 103 updates a frequency distribution (histogram) stored in the characteristic storage unit 105, using the acoustic characteristic amount of a current frame.

(2) Case in which Plural Different Acoustic Characteristic Amounts are Used

FIG. 4B is a flowchart illustrating an example of voice correction processing (2) in the first embodiment. In Step S201 illustrated in FIG. 4B, the acoustic characteristic amount calculation unit 101 calculates a plurality of different acoustic characteristic amounts (for example, the voice level and the speaking speed) from an input voice signal.

In Step S202, the correction control unit 107 compares the calculated plural different acoustic characteristic amounts with corresponding defective acoustic characteristic amounts stored in the characteristic storage unit 105, and determines whether or not that performs correction. For example, when at least one of the calculated plural different acoustic characteristic amounts is within a predetermined range including the corresponding defective acoustic characteristic amount, the correction control unit 107 determines that performs correction (Step S202: YES), and the processing proceeds to Step S203. In addition, when none of the calculated plural different acoustic characteristic amounts is within a predetermined range including the corresponding defective acoustic characteristic amount, the correction control unit 107 determines that does not performs correction (Step S202: NO), and the processing proceeds to Step S205.

In Step S203, the correction control unit 107 calculates a correction amount using the normal acoustic characteristic amount stored in the characteristic storage unit 105. For example, the correction control unit 107 calculates the correction amount of the acoustic characteristic amount so that the acoustic characteristic amount is within a predetermined range including the average value of the normal acoustic characteristic amount.

In Step S204, the correction unit 109 corrects a voice signal on the basis of the correction amount calculated in the correction control unit 107.

In Step S205, the response detection unit 111 determines whether or not a response has occurred from a user. When the response occurs from the user (Step S205: YES), the processing proceeds to Step S206, and when no response occurs from the user (Step S205: NO), the processing proceeds to Step S210.

In Step S209, the characteristic analysis unit 103 determines whether or not at least one acoustic characteristic amount is to be selected from among the plural different acoustic characteristic amounts. In this determination, one of "to be selected" and "not to be selected" may be preliminarily set.

When the acoustic characteristic amount is to be selected (Step S206: YES), the characteristic analysis unit 103 proceeds to a processing operation in Step S207, and when the acoustic characteristic amount is not to be selected (Step S206: NO), the characteristic analysis unit 103 proceeds to a processing operation in Step S209.

In Step S207, from among the plural different acoustic characteristic amounts, the characteristic analysis unit 103 selects an acoustic characteristic amount serving as a factor for indistinctness, from the plural acoustic characteristic amounts. As for the selection, an acoustic characteristic amount may be selected where a difference between the average of the statistic amount (for example, the frequency distribution) of the normal acoustic characteristic amount and the acoustic characteristic amount at the time of the acquisition of the response signal is the largest.

In Step S208, the characteristic analysis unit 103 registers the selected acoustic characteristic amount in the characteristic storage unit 105, as a defective acoustic characteristic amount.

In Step S209, the characteristic analysis unit 103 registers the calculated plural different acoustic characteristic amounts in the characteristic storage unit 105, as defective acoustic characteristic amounts.

In Step S210, using the plural different acoustic characteristic amounts of a current frame, the characteristic analysis unit 103 updates each frequency distribution (histogram) stored in the characteristic storage unit 105.

As described above, according to the first embodiment, it is possible to cause a voice to be easily heard in response to how much the user hears (audibility), on the basis of a simple response. In addition, according to the first embodiment, it is possible to learn a defective acoustic characteristic amount with an increase in the number of responses from the user, and it is possible to cause a sound quality to be easily heard in accordance with the preference of the user.

Second Embodiment

Next, a mobile terminal device 2 in a second embodiment will be described. The mobile terminal device 2 illustrated in the second embodiment includes a voice correction unit 20, uses the power of an input signal as an acoustic characteristic amount, and uses an acceleration sensor as a response detection unit. The power of the input signal is a voice level in a frequency domain.

Figure 5:
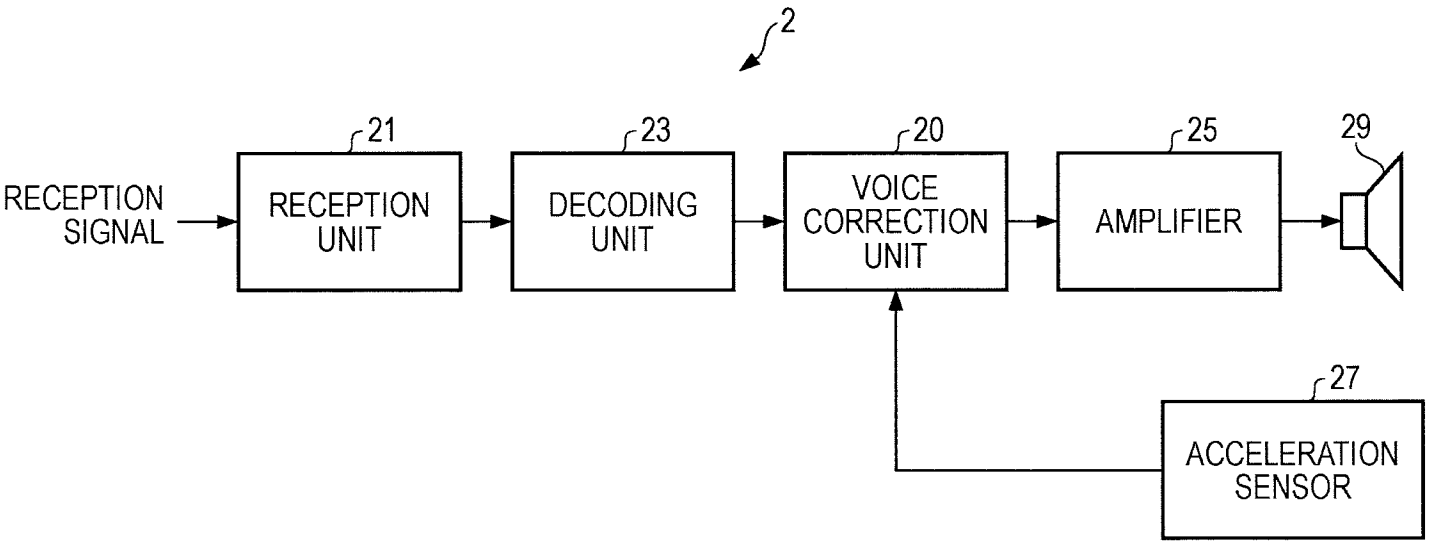
FIG. 5 is a block diagram illustrating an example of a configuration of a mobile terminal device in a second embodiment.

FIG. 5 is a block diagram illustrating an example of the configuration of the mobile terminal device 2 in the second embodiment. The mobile terminal device 2 illustrated in FIG. 5 includes a reception unit 21, a decoding unit 23, a voice correction unit 20, an amplifier 25, an acceleration sensor 27, and a speaker 29.

The reception unit 21 receives a reception signal from a base station. The decoding unit 23 decodes and converts the reception signal into a voice signal.

In response to a response signal from the acceleration sensor 27, the voice correction unit 20 stores the power of an indistinct voice signal, and, on the basis of the stored power, corrects the voice signal so that the voice signal is easily heard. The voice correction unit 20 outputs the corrected voice signal to the amplifier 25.

The amplifier 25 amplifies the acquired voice signal. The voice signal output from the amplifier 25 is D/A-converted and output from the speaker 29 as an output sound.

The acceleration sensor 27 detects a preliminarily set shock to a chassis, and outputs a response signal to the voice correction unit 20. For example, the preliminarily set shock is a double tap or the like.

Figure 6:
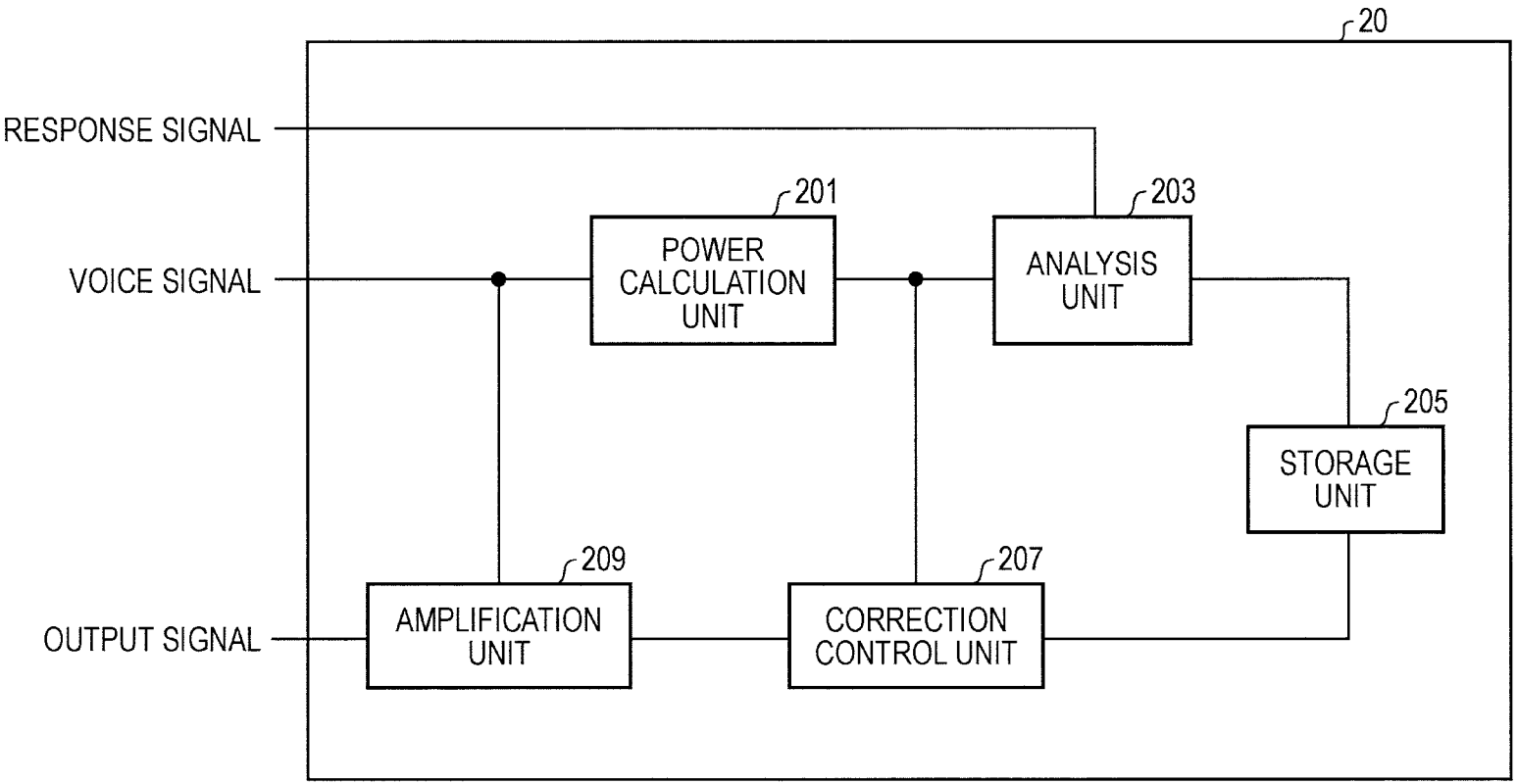
FIG. 6 is a block diagram illustrating an example of a configuration of a voice correction unit in the second embodiment.

FIG. 6 is a block diagram illustrating an example of the configuration of the voice correction unit 20 in the second embodiment. The voice correction unit 20 illustrated in FIG. 6 includes a power calculation unit 201, an analysis unit 203, a storage unit 205, a correction control unit 207, and an amplification unit 209.

The power calculation unit 201 calculates power with respect to the input voice signal, on the basis of the following Expression (1).

$$p(n) = \frac{1}{N} \cdot \sum_i (x(i))^2 \qquad \text{Expression (1)}$$

x( ): a voice signal i: a sample number p( ): frame power

N: the number of samples in one frame n: a frame number

The power calculation unit 201 outputs the calculated power to the analysis unit 203 and the correction control unit 207.

When there is no response signal, the analysis unit 203 updates the average value of power on the basis of the following Expression (2). Here, the average value is used as a statistic amount.

$$\overline{p}(n)=\alpha\cdot\overline{p}(n-1)+(1-\alpha)\cdot p(n) \qquad \text{Expression (2)}$$

$\overline{p}$( ): the average value of power; for example, an initial value is 0

α: a first weight coefficient

The analysis unit 203 stores the updated average value of power in the storage unit 205.

When there is a response signal, the analysis unit 203 registers the calculated power, as the power of an indistinct voice, in the storage unit 205.

$$Z(j)=p(n) \qquad \text{Expression (3)}$$

Z( ): registered power j: the number of registrations; for example, an initial value is 0 j is incremented.

The storage unit 205 stores the registered power in addition to the average value of power and a registration number.

The correction control unit 207 calculates a correction amount using the average value of power stored in the storage unit 205. The calculation procedure of the correction amount will be described hereinafter. The correction control unit 207 defines the normal range of power on the basis of the following Expressions (4) and (5).

$$L_{low} = \beta \cdot \overline{p}(n) + (1+\beta) \cdot \max_k (Z(k) \mid Z(k) < \overline{p}(n)) \qquad \text{Expression (4)}$$

$$L_{high} = \beta \cdot \overline{p}(n) + (1-\beta) \cdot \min_k (Z(k) \mid Z(k) > \overline{p}(n)) \qquad \text{Expression (5)}$$

$L_{low}$: the lower limit value of the normal range $L_{high}$: the upper limit value of the normal range β: a second weight coefficient The correction control unit 207 defines a range of from $L_{low}$ to $L_{high}$ as the normal range.

Figure 7:
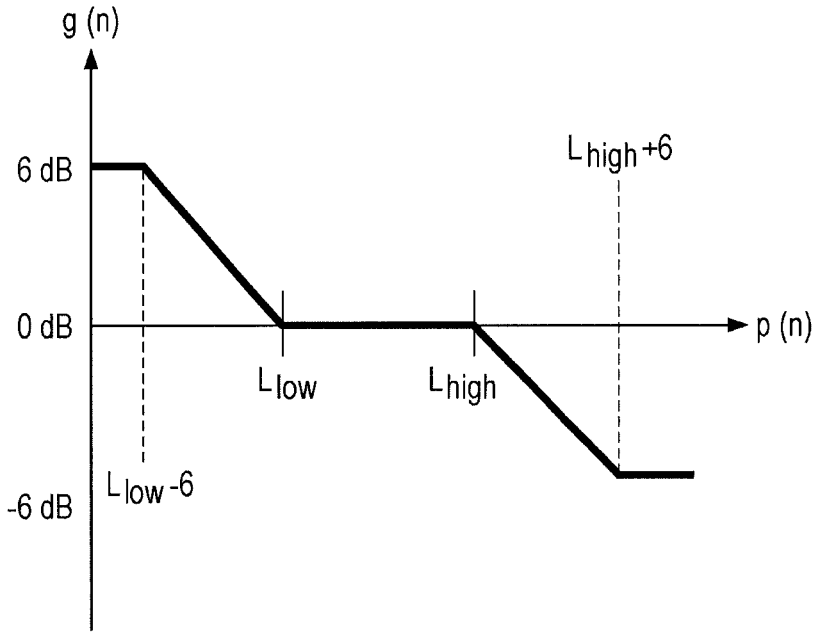
FIG. 7 is a diagram illustrating an example of a correction amount.

The correction control unit 207 calculates a correction amount g(n) using a conversion equation illustrated in FIG. 7. FIG. 7 is a diagram illustrating an example of a correction amount. In the example illustrated in FIG. 7, the correction amount g(n) is as follows. When p(n) is less than $L_{low}-6$, the g(n) is 6 dB. For example, the amount of 6 dB is an amount where a user feels that a voice has changed. When the p(n) is greater than or equal to $L_{low}-6$ and less than $L_{low}$, the g(n) decreases from 6 dB to 0 dB in proportion to the p(n). When the p(n) is greater than or equal to $L_{low}$ and less than $L_{high}$, the g(n) is 0 dB. When the p(n) is greater than or equal to $L_{high}$ and less than $L_{high}+6$, the g(n) decreases from 0 dB to −6 dB in proportion to the p(n). When the p(n) is greater than or equal to $L_{high}+6$, the g(n) is −6 dB.

The correction control unit 207 outputs the calculated correction amount g(n) to the amplification unit 209. In addition, the upper limit value, 6, and the lower limit value, −6, of the g(n) illustrated in FIG. 7 are examples, and adequate values may be set on the basis of an experiment. In addition, when a value, 6, subtracted from the $L_{low}$ of the p(n) and a value, 6, added to $L_{high}$ thereof are examples, and adequate values may be individually set on the basis of an experiment.

Returning to FIG. 6, using the following Expression (6), the amplification unit 209 multiplies the voice signal by the correction amount acquired from the correction control unit 207, thereby correcting the voice signal.

$$y(i)=x(i)\cdot 10^{g(n)/20} \quad \text{Expression (6)}$$

y( ): an output signal (corrected voice signal)

<Operation>

Figure 8:
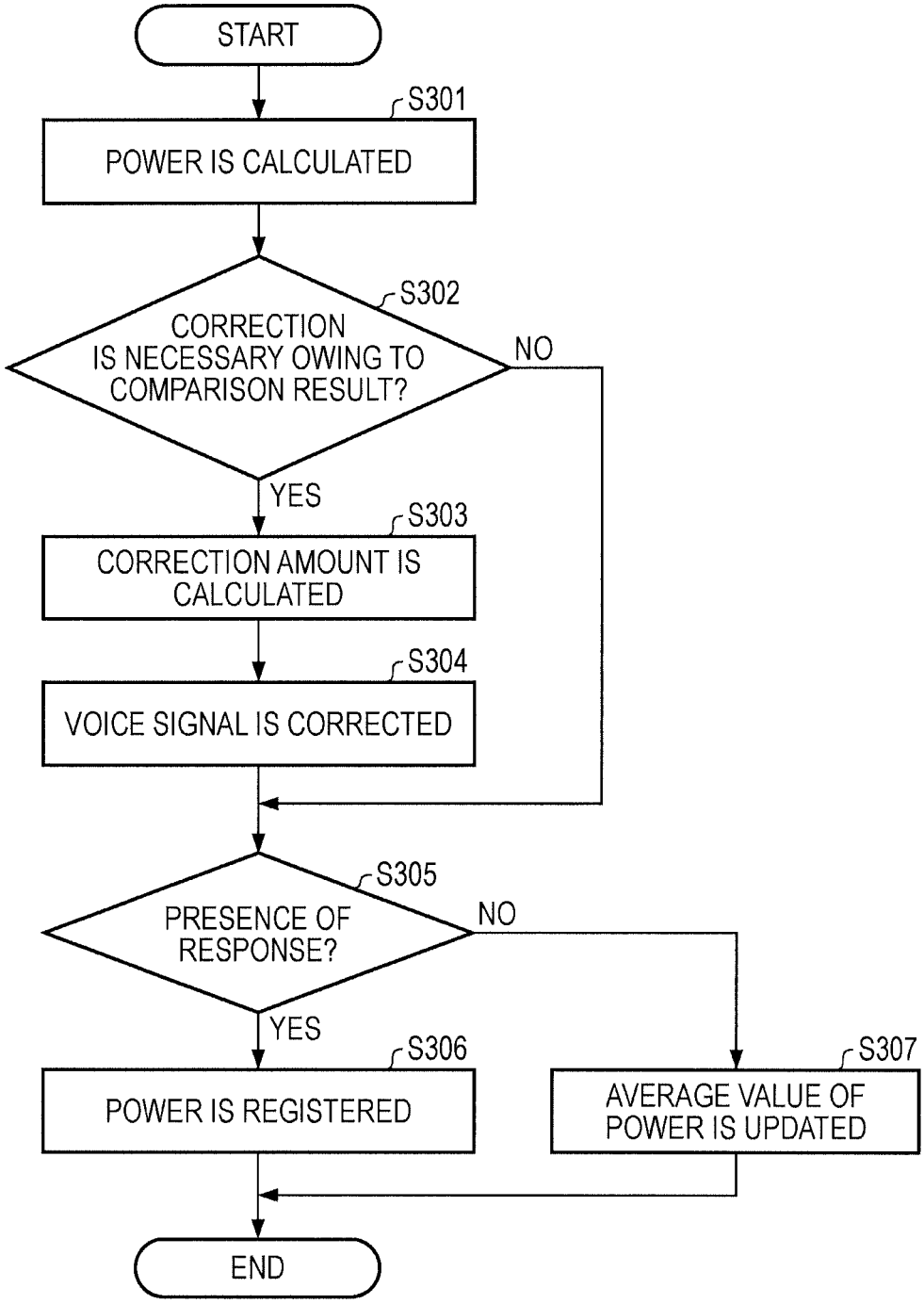
FIG. 8 is a flowchart illustrating an example of voice correction processing in the second embodiment.

Next, the operation of the voice correction unit 20 in the second embodiment will be described. FIG. 8 is a flowchart illustrating an example of voice correction processing in the second embodiment. In S301 illustrated in FIG. 8, the power calculation unit 201 calculates the power of the input voice signal on the basis of, for example, Expression (1).

In Step S302, the correction control unit 207 compares the power of a current frame with the power of a normal range stored in the storage unit 205, and determines whether or not that performs correction. When the power of the current frame is not within the normal range, the correction control unit 207 determines that performs correction (Step S302: YES), and proceeds to Step S303. In addition, when the power of the current frame is within the normal range, the correction control unit 207 determines that does not performs correction (Step S302: NO), and proceeds to Step S305.

In Step S303, using the average value of normal power stored in the storage unit 205, the correction control unit 207 calculates the correction amount on the basis of, for example, such a conversion equation as illustrated in FIG. 7.

In Step S304, the amplification unit 209 corrects (amplifies) the voice signal on the basis of the correction amount calculated in the correction control unit 207.

In Step S305, the analysis unit 203 determines whether or not a response signal occurs from the acceleration sensor 27. When a preliminarily set shock has occurred, the acceleration sensor 27 outputs the response signal to the analysis unit 203. When the response signal occurs (Step S305: YES), the processing proceeds to Step S306, and when no response signal occurs (Step S305: NO), the processing proceeds to Step S307.

In Step S306, the analysis unit 203 registers, as defective power, a predetermined number of frames including the current frame at the time of the occurrence of the response signal in the storage unit 205.

In Step S307, when no response signal occurs, the analysis unit 203 updates and stores the average value of power in the storage unit 205.

As described above, according to the second embodiment, using the power of the voice signal and the acceleration sensor 27, it is possible to correct a voice so that the voice is easily heard in response to the audibility of the user, on the basis of a simple response at a time when the user has felt indistinctness.

Third Embodiment

Next, a mobile terminal device 3 in a third embodiment will be described. The mobile terminal device 3 illustrated in the third embodiment includes a voice correction unit 30, uses the speaking speed of an input signal as an acoustic characteristic amount, and uses a key input sensor 31 as a response detection unit.

Figure 9:
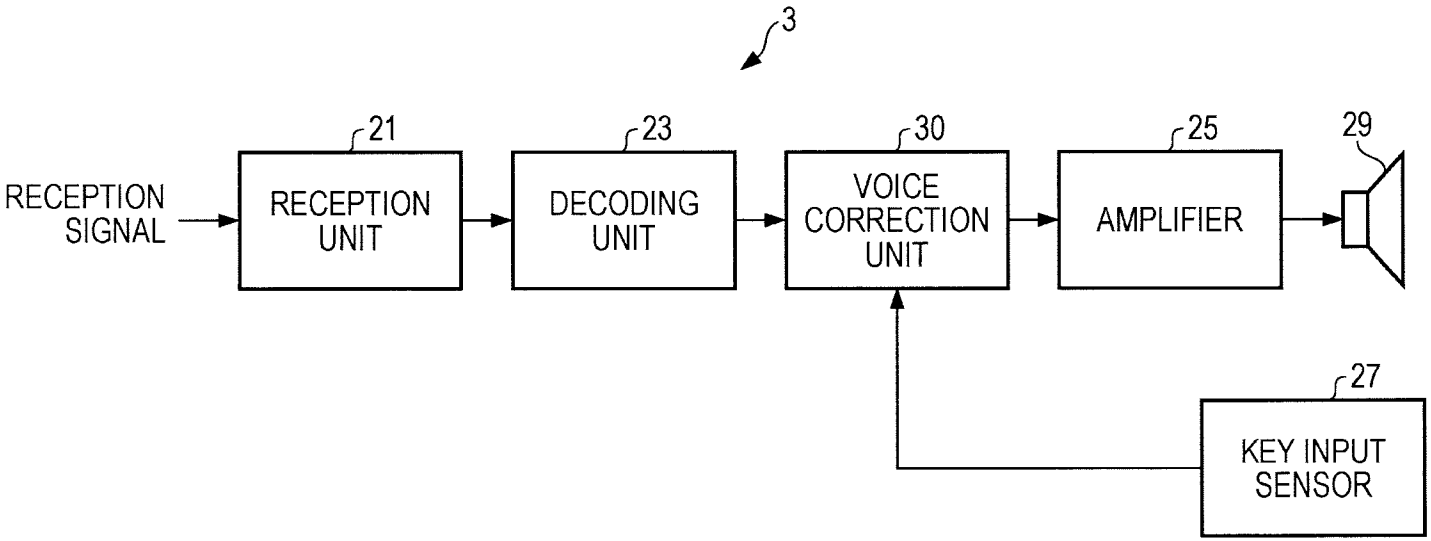
FIG. 9 is a block diagram illustrating an example of a configuration of a mobile terminal device in a third embodiment.

FIG. 9 is a block diagram illustrating an example of the configuration of the mobile terminal device 3 in the third embodiment. When, in the configuration illustrated in FIG. 9, there is the same configuration as the configuration illustrated in FIG. 5, the same symbol is assigned thereto and the description thereof will be omitted.

The mobile terminal device 3 illustrated in FIG. 9 includes the reception unit 21, the decoding unit 23, a voice correction unit 30, the amplifier 25, a key input sensor 31, and the speaker 29.

In response to a response signal from the key input sensor 31, the voice correction unit 30 stores the speaking speed of an indistinct voice signal, and, on the basis of the stored speaking speed, corrects the voice signal so that the voice signal is easily heard. The voice correction unit 30 outputs the corrected voice signal to the amplifier 25.

The key input sensor 31 detects holding down of a preliminarily set button during a telephone call, and outputs a response signal to the voice correction unit 30. For example, the preliminarily set button is an existing key or a newly provided key.

Figure 10:
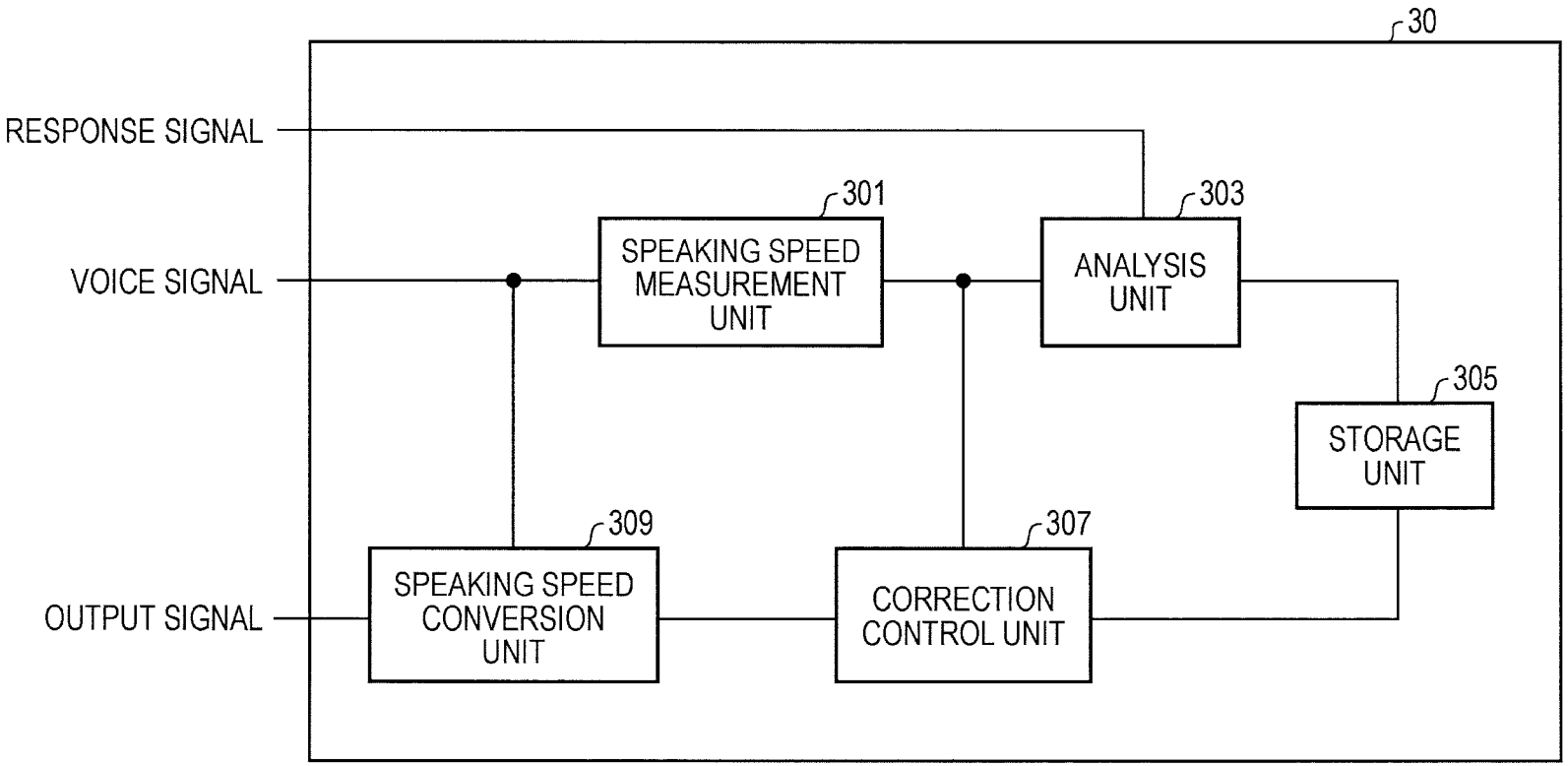
FIG. 10 is a block diagram illustrating an example of a configuration of a voice correction unit in the third embodiment.

FIG. 10 is a block diagram illustrating an example of the configuration of the voice correction unit 30 in the third embodiment. The voice correction unit 30 illustrated in FIG. 10 includes a speaking speed measurement unit 301, an analysis unit 303, a storage unit 305, a correction control unit 307, and a speaking speed conversion unit 309.

The speaking speed measurement unit 301 estimates, for example, the number of moras m(n) during one previous second with respect to an input voice signal. The number of moras means the number of kana characters of a single word. As for the estimation of the number of moras, an existing technique may be used. The speaking speed measurement unit 301 outputs the estimated speaking speed to the analysis unit 303 and the correction control unit 307.

When there is no response signal, the analysis unit 303 updates the frequency distribution of the speaking speed on the basis of the following Expression (7). Here, the frequency distribution is used as a statistic amount.

$$H_n(m(n))=H_{n-1}(m(n))+1 \quad \text{Expression (7)}$$

m(n): a speaking speed (the number of moras per second)

H( ): the frequency distribution of a speaker; an initial value is 0 n: a frame number

The analysis unit 303 stores the updated frequency distribution of the speaking speed in the storage unit 305.

When there is a response signal, the analysis unit 303 registers the estimated speaking speed, as the speaking speed of an indistinct voice, in the storage unit 305. The analysis unit 303 registers the speaking speed of the indistinct voice on the basis of the following procedure. The analysis unit 303 calculates the reference value of the speaking speed on the basis of the following Expression (8). For example, it is assumed that the reference value is the mode of the frequency distribution.

$$\hat{m}(n) = \underset{i}{\operatorname{argmax}}(H_n(x)) \qquad \text{Expression (8)}$$

$\hat{m}$( ): the mode of the speaking speed

On the basis of the reference value of the speaking speed, the analysis unit 303 calculates the degree of contribution to indistinctness in accordance with the following Expression (9).

$$q(n)=|\hat{m}(n)-m(n)| \qquad \text{Expression (9)}$$

q( ): the degree of contribution

When the degree of contribution q(n) is greater than or equal to a threshold value, the analysis unit 303 registers the speaking speed in the storage unit 305.

$$W(j)=m(n) \qquad \text{Expression (10)}$$

W( ): a registered speaking speed j: the number of registrations for example, an initial value is 0 j is incremented.

The storage unit 305 stores the registered speaking speed along with the frequency distribution of the speaking speed and a registration number.

The correction control unit 307 calculates a correction amount using the registered speaking speed stored in the storage unit 205. In this case, the correction amount is a target extension rate.

$$r(n) = \begin{cases} 1.4 & m(n) > \max_k(Z(k)) \text{ at the time of} \\ 1.0 & \text{otherwise} \end{cases} \qquad \text{Expression}$$

r( ): a target extension rate

For example, when the speaking speed of a current frame is faster than the maximum level of the registered speaking speed, the correction control unit 307 defines the correction amount as 1.4 so as to expand the speaking speed. When the speaking speed of the current frame is less than or equal to the maximum level of the registered speaking speed, the correction control unit 307 defines the correction amount as 1.0. In addition, more than two target extension rates may be set, and threshold values according to the number of target extension rates may be set.

The speaking speed conversion unit 309 converts the speaking speed on the basis of the correction amount (target extension rate) acquired from the correction control unit 307, thereby correcting the voice signal. An example of the speaking speed conversion is disclosed in Japanese Patent No. 3619946.

In Japanese Patent No. 3619946, there is calculated a parameter value that indicates the characteristic of a voice with respect to each predetermined time interval separated with a predetermined period of time, the reproduction speed of a voice signal with respect to each predetermined time interval is calculated in response to the parameter value, and reproduction data is generated on the basis of the calculated reproduction speed. Furthermore, in this patent literature, pieces of reproduction data of individual predetermined time intervals are connected to one another, and voice data is output with no pitch being changed and a speaking speed being only changed.

The speaking speed conversion unit 309 may convert the speaking speed using any one of speaking speed conversion techniques of the related art including the above-mentioned patent literature.

<Operation>

Figure 11:
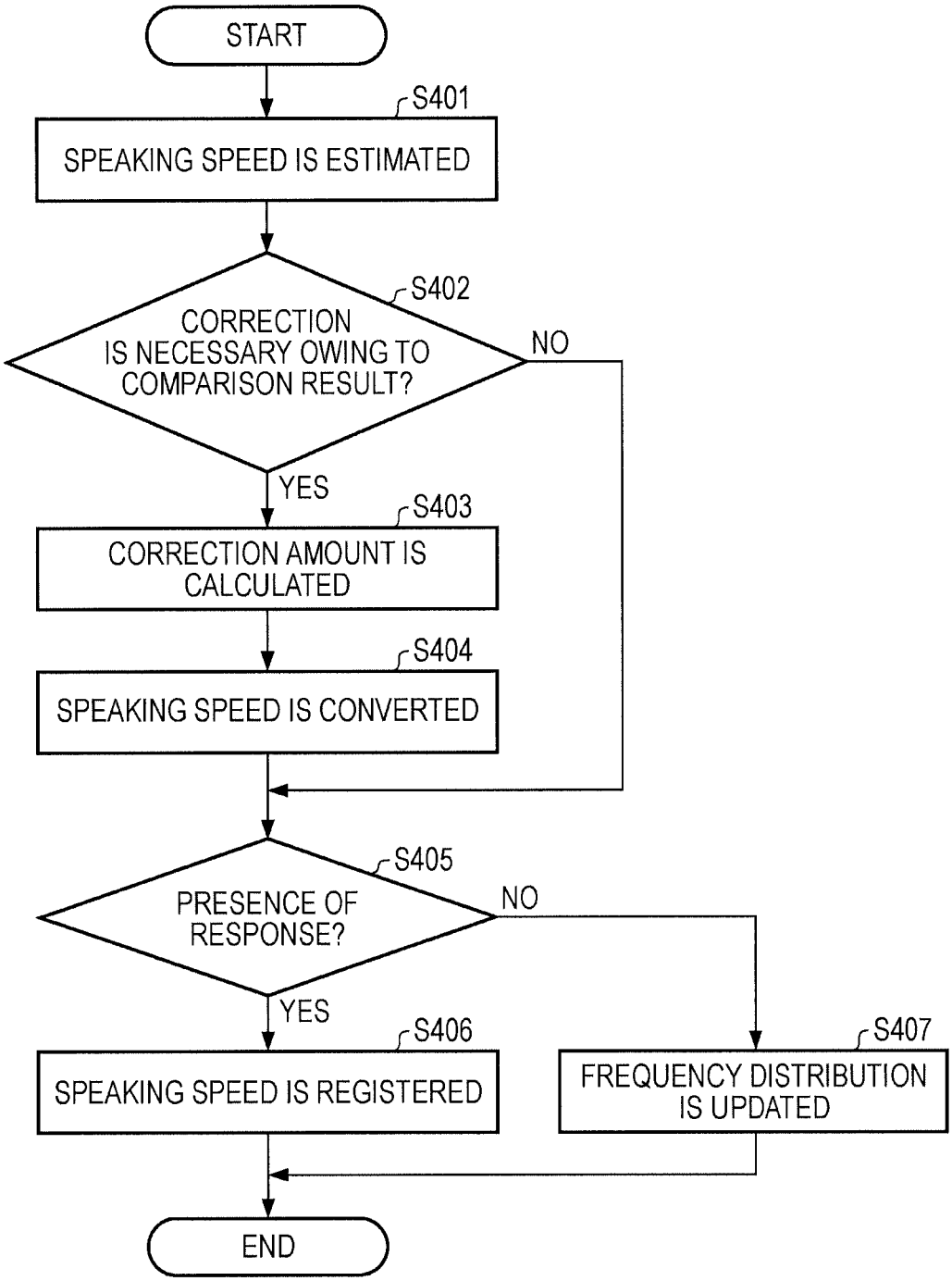
FIG. 11 is a flowchart illustrating an example of voice correction processing in the third embodiment.

Next, the operation of the voice correction unit 30 in the third embodiment will be described. FIG. 11 is a flowchart illustrating an example of voice correction processing in the third embodiment. In S401 illustrated in FIG. 11, the speaking speed measurement unit 301 estimates the speaking speed of an input voice signal using the number of moras.

In Step S402, the correction control unit 307 compares the speaking speed of a current frame with the mode of the speaking speed stored in the storage unit 305, and determines whether or not that performs correction. When the absolute value of a difference between the speaking speed of the current frame and the mode is greater than or equal to a threshold value, the correction control unit 307 determines that performs correction (Step S402: YES), and proceeds to Step S403. In addition, the absolute value of the difference is less than the threshold value, the correction control unit 307 determines that does not perform correction (Step S402: NO), and proceeds to Step S405.

In Step S403, the correction control unit 307 calculates a correction amount using the maximal value of the registered speaking speed stored in the storage unit 305.

In Step S404, the speaking speed conversion unit 309 corrects the voice signal (performs speaking speed conversion) on the basis of the correction amount calculated in the correction control unit 307.

In Step S405, the analysis unit 303 determines whether or not a response signal occurs from the key input sensor 31. When a preliminarily set key is held down (input), the key input sensor 31 outputs the response signal to the analysis unit 303. When the response signal occurs (Step S405: YES), the processing proceeds to Step S406. In addition, when no response signal occurs (Step S405: NO), the processing proceeds to Step S407.

In Step S406, the analysis unit 303 calculates the number of moras during one second based on a time when the response signal has occurred, and registers, as a defective speaking speed, the number of moras in the storage unit 305. For example, it is assumed that one second in this case is one second prior to the time when the response signal has occurred.

In Step S407, when no response signal occurs, the analysis unit 303 updates and stores the frequency distribution of the speaking speed in the storage unit 305.

As described above, according to the third embodiment, using the speaking speed of the voice signal and the key input sensor 31, it is possible to correct a voice so that the voice is easily heard in response to the audibility of the user, on the basis of a simple response at a time when the user has felt indistinctness. In addition, according to the third embodiment, the degree of contribution is calculated, and when the degree of contribution is high, the voice signal is determined to be defective and it is possible to store the acoustic characteristic amount. In addition, the calculation of the degree of contribution is not limited to the speaking speed, and the degree of contribution may also be calculated with respect to another acoustic characteristic amount.

Fourth Embodiment

Next, a mobile terminal device 4 in a fourth embodiment will be described. The mobile terminal device 4 illustrated in the fourth embodiment includes a voice correction unit 40, uses three types, such as the voice level and the SNR of an input signal and the noise level of a microphone signal, as acoustic characteristic amounts, and uses the key input sensor 31 as a response detection unit.

Figure 12:
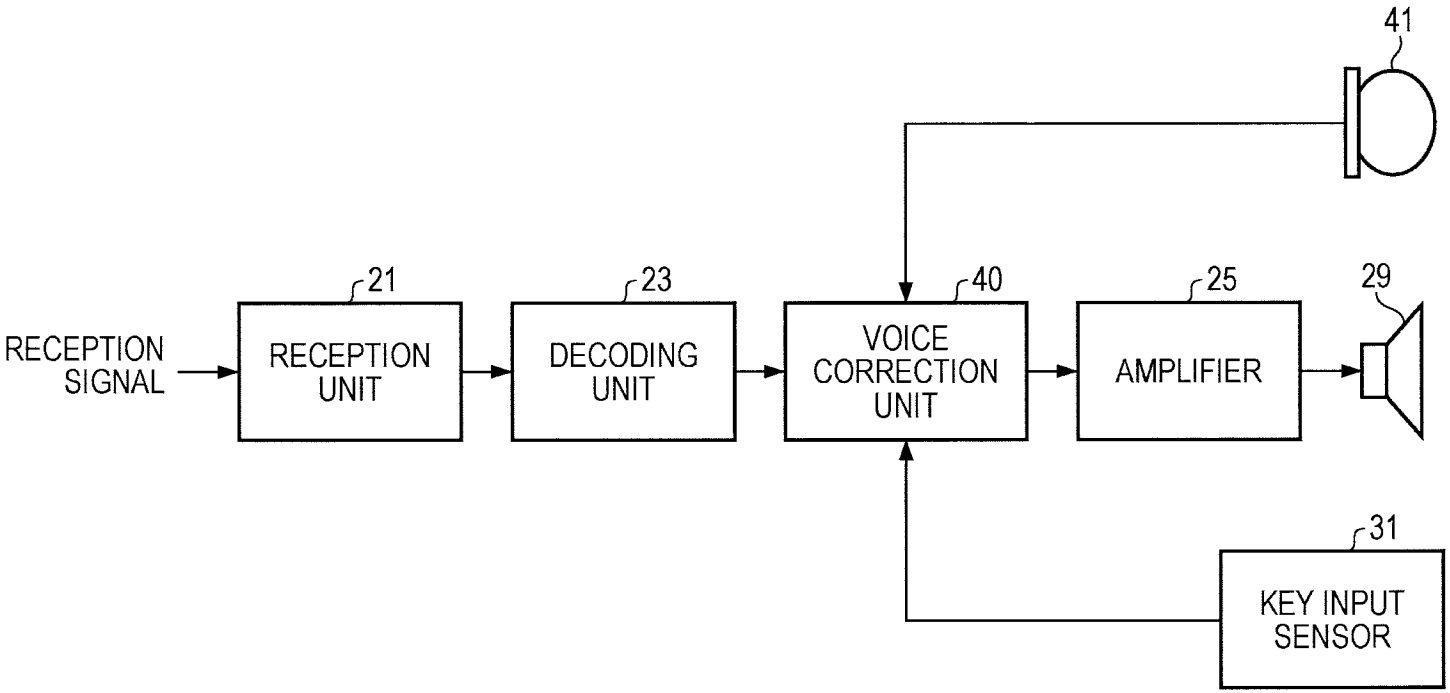
FIG. 12 is a block diagram illustrating an example of a configuration of a mobile terminal device in a fourth embodiment.

FIG. 12 is a block diagram illustrating an example of the configuration of the mobile terminal device 4 in the fourth embodiment. When, in the configuration illustrated in FIG. 12, there is the same configuration as the configuration illustrated in FIG. 5 or FIG. 9, the same symbol is assigned thereto and the description thereof will be omitted.

The mobile terminal device 4 illustrated in FIG. 12 includes the reception unit 21, the decoding unit 23, a voice correction unit 40, the amplifier 25, the key input sensor 31, the speaker 29, and a microphone 41.

In response to a response signal from the key input sensor 31, the voice correction unit 40 stores the acoustic characteristic amount of an indistinct voice signal, and, on the basis of the stored acoustic characteristic amount, corrects the voice signal so that the voice signal is easily heard. The voice correction unit 40 outputs the corrected voice signal to the amplifier 25. The microphone 41 inputs therein an ambient sound, and outputs, as a microphone signal, the ambient sound to the voice correction unit 40.

Figure 13:
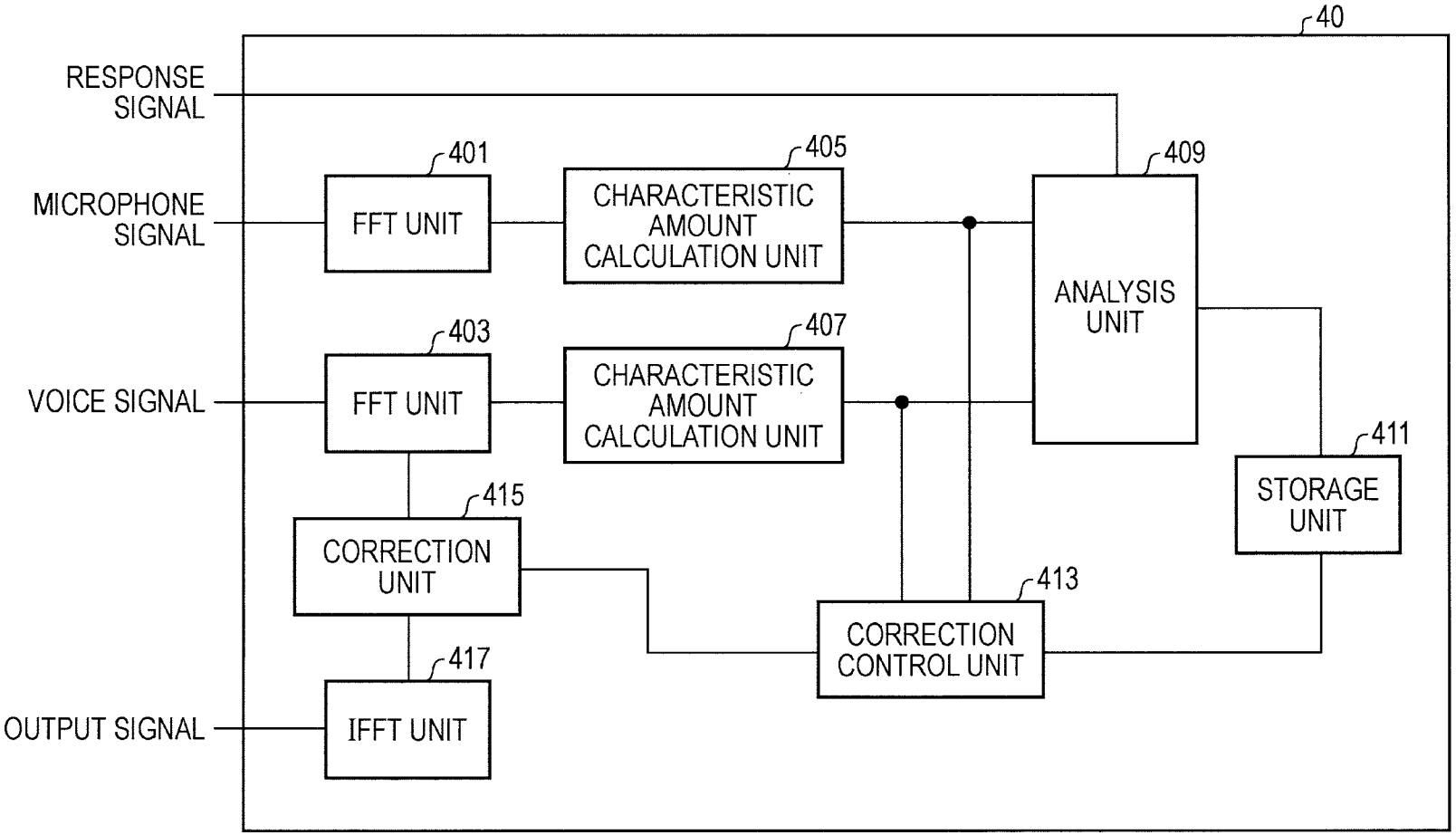
FIG. 13 is a block diagram illustrating an example of a configuration of a voice correction unit in the fourth embodiment.

FIG. 13 is a block diagram illustrating an example of the configuration of the voice correction unit 40 in the fourth embodiment. The voice correction unit 40 illustrated in FIG. 13 includes FFT units 401 and 403, characteristic amount calculation units 405 and 407, an analysis unit 409, a storage unit 411, a correction control unit 413, a correction unit 415, and an IFFT unit 419.

The FFT unit 401 performs fast Fourier transform (FFT) processing on the microphone signal to calculate the spectrum thereof. The FFT unit 401 outputs the calculated spectrum to the characteristic amount calculation unit 405.

The FFT unit 403 performs fast Fourier transform (FFT) processing on the input voice signal to calculate the spectrum thereof. The FFT unit 403 outputs the calculated spectrum to the characteristic amount calculation unit 407 and the correction unit 415.

In addition, while FFT is cited as an example of the time-frequency transform, the FFT units 401 and 403 may be processing units performing other time-frequency transform.

The characteristic amount calculation unit 405 estimates a noise level $N_{MIC}(n)$ from the spectrum of the microphone signal. The characteristic amount calculation unit 405 outputs the calculated noise level to the analysis unit 409 and the correction control unit 413.

The characteristic amount calculation unit 407 estimates a voice level S(n) and a signal-to-noise ratio SNR(n) from the spectrum of the voice signal. The SNR(n) is obtained on the basis of S(n)/N(n). The N(n) is the noise level of the voice signal. The characteristic amount calculation unit 407 outputs the calculated voice level and the calculated SNR to the analysis unit 409 and the correction control unit 413.

When there is no response signal, the analysis unit 409 updates and stores the frequency distribution of each acoustic characteristic amount in the storage unit 411. Here, as the statistic amount, the frequency distribution is used.

Figure 14A:
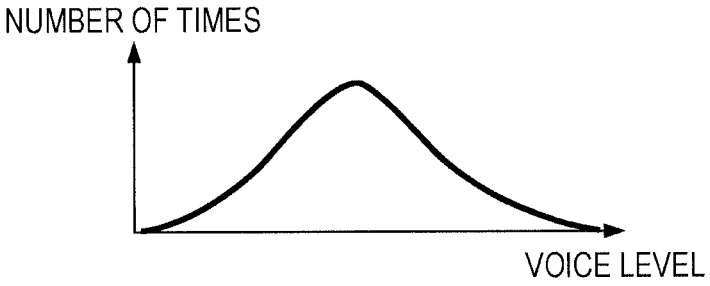
FIGS. 14A to 14C are diagrams illustrating examples of frequency distributions of individual acoustic characteristic amounts.
Figure 14B:
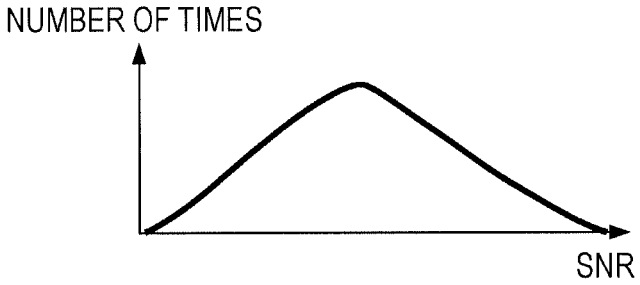
Figure 14C:
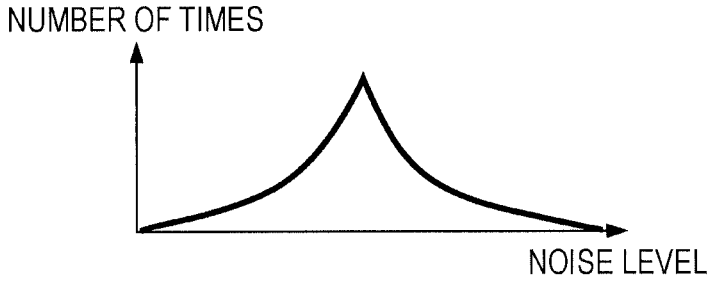

FIGS. 14A to 14C are diagrams illustrating examples of the frequency distributions of individual acoustic characteristic amounts. FIG. 14A illustrates an example of the frequency distribution of the voice level. FIG. 14B illustrates an example of the frequency distribution of the SNR. FIG. 14C illustrates an example of the frequency distribution of the noise level.

When there is a response signal, the analysis unit 409 calculates the average value of previous M frames of each acoustic characteristic amount on the basis of the following Expression.

$$\overline{S(n)} = \frac{1}{M}\sum_{i=0}^{M}(S(n-i)) \quad \text{Expression (11)}$$

$$\overline{SNR(n)} = \frac{1}{M}\sum_{i=0}^{M}(SNR(n-i)) \quad \text{Expression (12)}$$

$$\overline{N_{MIC}(n)} = \frac{1}{M}\sum_{i=0}^{M}(N_{MIC}(n-i)) \quad \text{Expression (13)}$$

After having calculated the average values of individual acoustic characteristic amounts, the analysis unit 409 compares the average values with the frequency distributions thereof, and selects an acoustic characteristic amount where the numbers of times corresponding to the average value is the lowest.

Figure 15A:
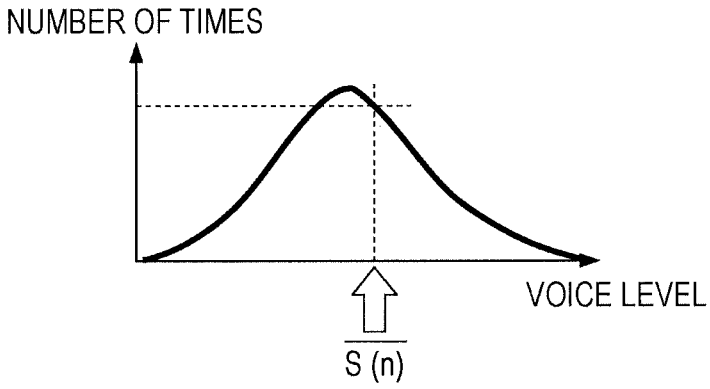
FIGS. 15A to 15C are diagrams illustrating examples of relationships between averages of individual acoustic characteristic amounts and the numbers of times thereof.
Figure 15B:
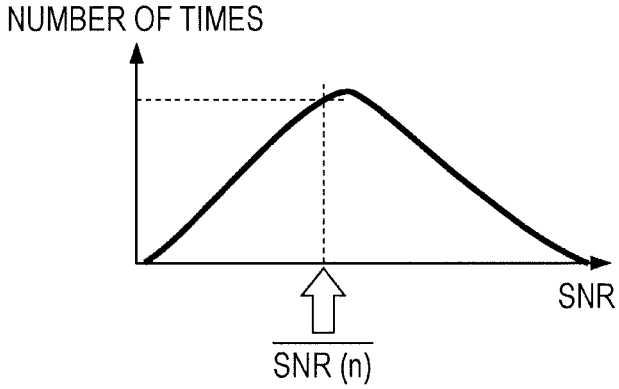
Figure 15C:
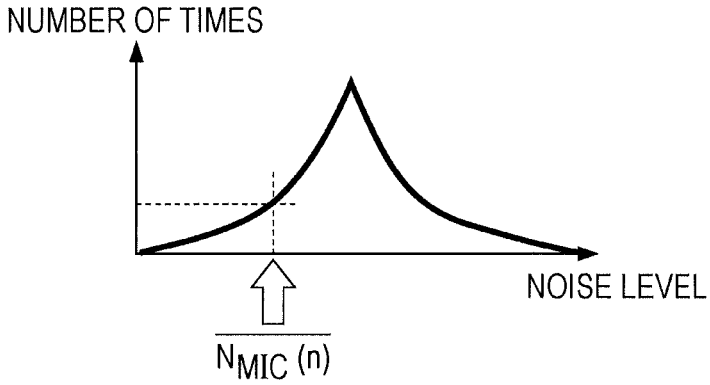

FIGS. 15A to 15C are diagrams illustrating examples of relationships between the averages of individual acoustic characteristic amounts and the numbers of times thereof. FIG. 15A illustrates the number of times corresponding to the average value of the voice level. FIG. 15B illustrates the number of times corresponding to the average value of the SNR. FIG. 15C illustrates the number of times corresponding to the average value of the noise level.

In the examples illustrated in FIGS. 15A to 15C, the number of times corresponding to the average value of the voice level is less than the numbers of times corresponding to the average values of the other acoustic characteristic amounts. Accordingly, the analysis unit 409 selects the noise level as the cause of indistinctness. The analysis unit 409 registers the selected acoustic characteristic amount in the storage unit 411. In the examples illustrated in FIGS. 15A to 15C, the noise level is registered in the storage unit 411. The storage unit 411 stores therein the frequency distribution of each acoustic characteristic amount and an acoustic characteristic amount registered as a defective.

Figure 16A:
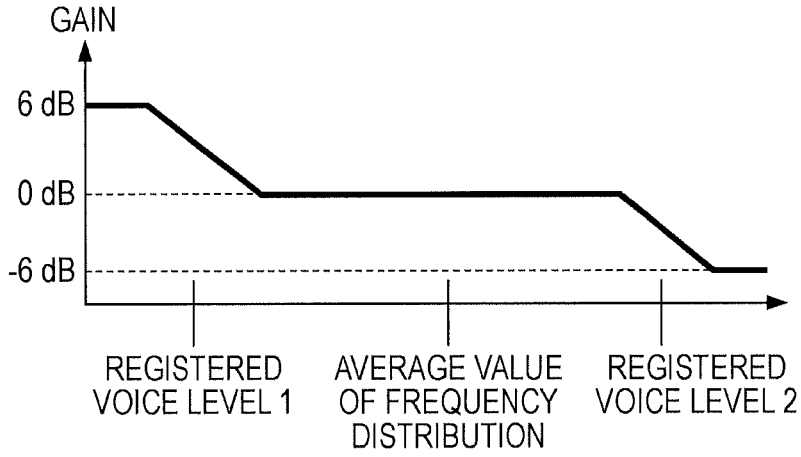
FIGS. 16A to 16C are diagrams illustrating examples of correction amounts of individual acoustic characteristic amounts.
Figure 16B:
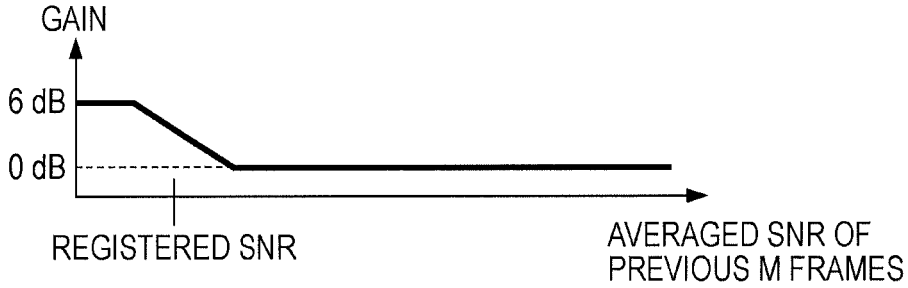
Figure 16C:
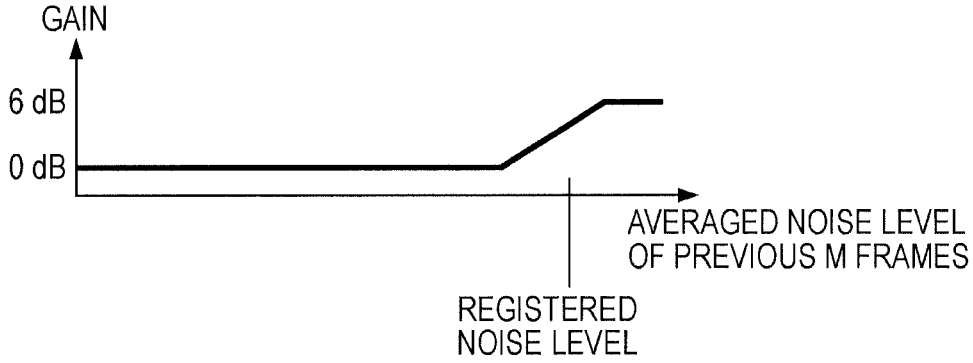

Returning to FIG. 13, the correction control unit 413 calculates a correction amount using the frequency distribution of each acoustic characteristic amount, stored in the storage unit 205, the registered acoustic characteristic amount, and the average of previous M frames prior to the current frame. The correction amount of each acoustic characteristic amount will be described using FIGS. 16A to 16C. FIGS. 16A to 16C are diagrams illustrating examples of the correction amounts of individual acoustic characteristic amounts.

In a case in which the correction amount of the voice level is calculated: FIG. 16A is a diagram illustrating an example of the correction amount of the voice level. In the example illustrated in FIG. 16A, first, the correction control unit 413 obtains registered voice levels 1 and 2. It is assumed that the registered voice level 1 is a registered voice level of a maximal value from among voice levels (registered voice levels) less than or equal to the average value of a frequency distribution and registered in the storage unit 411. In addition, when there is no registered voice level less than or equal to the average value of a frequency distribution, the registered voice level 1 is defined as "0".

For example, it is assumed that the registered voice level 2 is a registered voice level of a minimum value from among registered voice levels greater than or equal to the average value of a frequency distribution. In addition, when there is no voice level greater than or equal to the average value of a frequency distribution, the registered voice level 2 is defined as an infinite value.

The correction control unit 413 calculates a correction amount on the basis of the relationship illustrated in FIG. 16A. For example, with respect to predetermined levels around the registered voice level 1, a correction amount is calculated so as to be decreased from 6 dB to 0 dB in proportion to the voice level. In addition, with respect to predetermined levels around the registered voice level 2, a correction amount is calculated so as to be decreased from 0 dB to −6 dB in proportion to the voice level.

In a case in which the correction amount of the SNR is calculated: FIG. 16B is a diagram illustrating an example of the correction amount of the SNR. In the example illustrated in FIG. 16B, with respect to predetermined SNRs around the SNR (registered SNR) registered in the storage unit 411, the correction control unit 413 calculates a correction amount so that the correction amount is decreased from 6 dB to 0 dB in proportion to the SNR.

In a case in which the correction amount of the noise level is calculated: FIG. 16C is a diagram illustrating an example of the correction amount of the noise level. In the example illustrated in FIG. 16C, with respect to predetermined noise levels around the noise level (registered noise level) registered in the storage unit 411, the correction control unit 413 calculates a correction amount so that the correction amount is increased from 0 dB to 6 dB in proportion to the noise level.

The correction unit 415 corrects the voice signal on the basis of the correction amount calculated by the correction control unit 413. For example, the correction unit 415 multiplies a spectrum input from the FFT unit 403 by the correction amount, there by performing correction processing. The correction unit 415 outputs the spectrum subjected to the correction processing to the IFFT unit 417.

The IFFT unit 419 performs inverse fast Fourier transform on the acquired spectrum, thereby calculating a temporal signal. In the processing, frequency-time transform corresponding to the time-frequency transform performed in the FFT units 401 and 403 may be performed.

<Operation>

Figure 17:
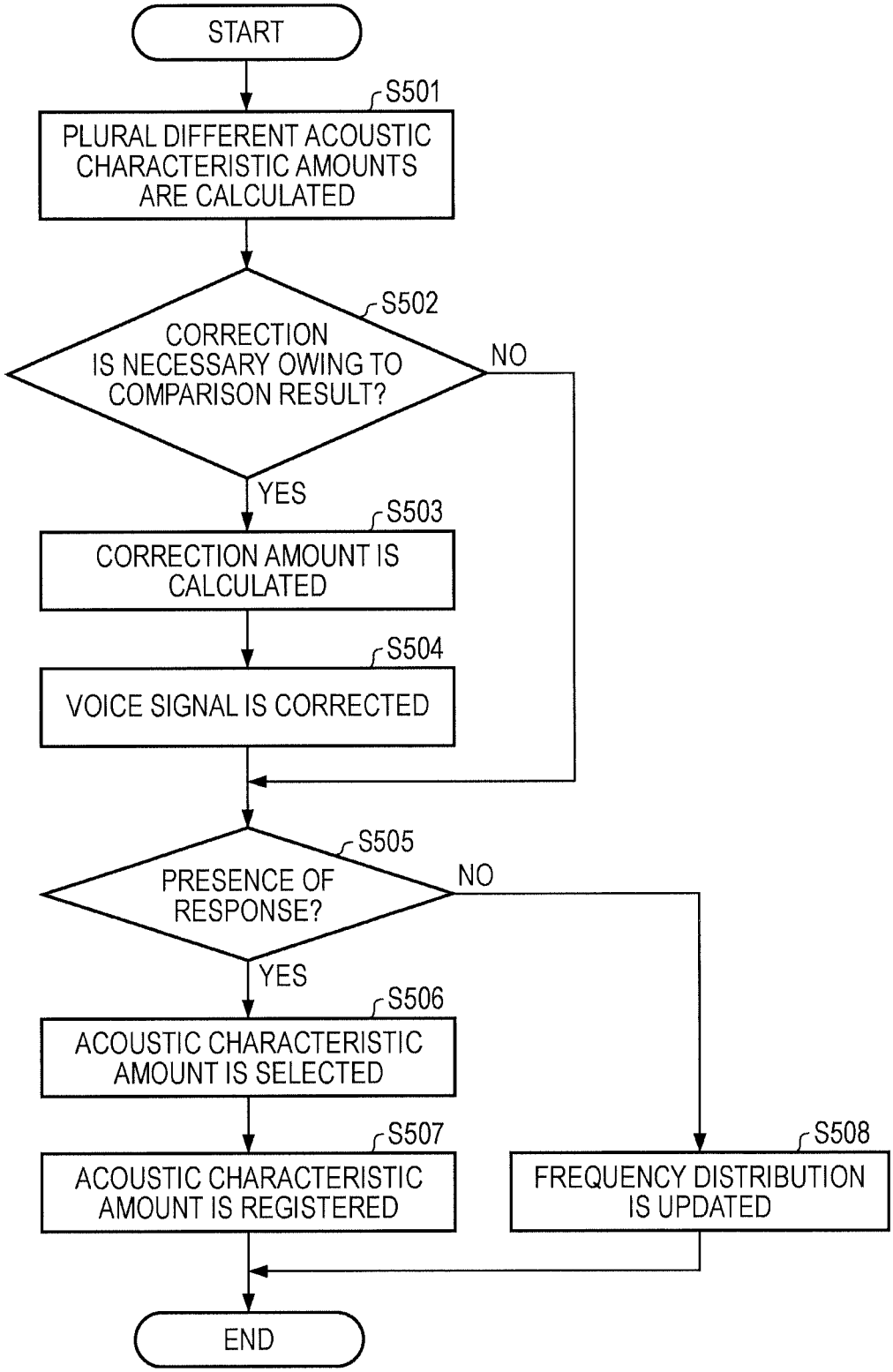
FIG. 17 is a flowchart illustrating an example of voice correction processing in the fourth embodiment.

Next, the operation of the voice correction unit 40 in the fourth embodiment will be described. FIG. 17 is a flowchart illustrating an example of voice correction processing in the fourth embodiment. In Step S501 illustrated in FIG. 17, the characteristic amount calculation units 405 and 407 calculate a plurality of different acoustic characteristic amounts from the voice signal and the microphone signal. In this case, the acoustic characteristic amounts are the voice level and the SNR of the voice signal and the noise level of the microphone signal.

In Step S502, the correction control unit 413 calculates the individual acoustic characteristic amounts of the current frame, compares the calculated individual acoustic characteristic amounts with individual acoustic characteristic amounts stored in the storage unit 411, and determines whether or not that performs correction.

For example, when the calculated individual acoustic characteristic amounts are within predetermined ranges including the defective acoustic characteristic amounts, it is determined that performs correction (Step S502: YES), and the processing proceeds to Step S503. In addition, when the calculated individual acoustic characteristic amounts are not within the predetermined ranges including the defective acoustic characteristic amounts, it is determined that dies not perform correction (Step S502: NO), and the processing proceeds to Step S505.

In Step S503, the correction control unit 413 calculates the correction amount of an acoustic characteristic amount needing to be corrected, using a normal acoustic characteristic amount stored in the characteristic storage unit 411. For example, the correction control unit 413 calculates the correction amounts of the acoustic characteristic amounts so that such relationships as illustrated in FIGS. 16A to 16C are satisfied.

In Step S504, the correction unit 415 corrects a voice signal on the basis of the correction amount calculated in the correction control unit 413.

In Step S505, the key input sensor 31 determines whether or not a response has occurred from a user. When the response occurs from the user (Step S505: YES), the processing proceeds to Step S506, and when no response occurs from the user (Step S505: NO), the processing proceeds to Step S508.

In Step S506, the analysis unit 409 selects a defective acoustic characteristic amount serving as a factor for indistinctness, from the voice level and the SNR of the voice signal and the noise level of the microphone signal. As for the selection, for example, using the statistic amount (for example, the frequency distribution) of a normal acoustic characteristic amount, an acoustic characteristic amount may be selected where the number of times of the average of the acoustic characteristic amount of previous M frames prior to the time of the acquisition of the response signal is the smallest (refer to FIGS. 15A to 15C). In addition, the selected acoustic characteristic amount may be a plurality of acoustic characteristic amounts.

In Step S507, the analysis unit 409 registers the selected acoustic characteristic amount as a defective acoustic characteristic amount in the storage unit 411.

In Step S508, the correction control unit 413 updates a frequency distribution (histogram) stored in the storage unit 411, using the acoustic characteristic amount of the current frame.

As described above, according to the fourth embodiment, using the voice level and the SNR of the voice signal, the noise level of the microphone signal, and the key input sensor 31, on the basis of a simple response made when a user has felt indistinctness, it is possible to correct a voice so that the voice is easily heard in response to the user's audibility.

In addition, in the fourth embodiment, since the plural acoustic characteristic amounts are used, it is easy to detect an acoustic characteristic amount serving as the cause of indistinctness and it is possible to remove the cause thereof. In addition, while, in the fourth embodiment, the voice level and the SNR of the voice signal are used, the combination of two or more than two from among acoustic characteristic amounts described in the first embodiment may be used.

Fifth Embodiment

Next, individual embodiments will be described in which a voice is caused to be easily heard in response to a factor for indistinctness and the audibility characteristic of a user. Examples of the factor for indistinctness include an ambient noise and the characteristics (a speaking speed and a fundamental frequency) of a received voice.

The indistinctness of a voice for the user tends to differ depending on each ambient noise around the user or each characteristic of a received voice. For example, a correction amount used for causing the voice to be easily heard in response to the ambient noise differs depending on the audibility characteristic of the user. Therefore, it is important to obtain a correction amount suitable for the user in response to the factor for indistinctness for the user and the audibility characteristic of the user.

In a fifth embodiment, with respect to each ambient noise serving as the factor for indistinctness, the response signal of a user in which the indistinctness is reflected, the acoustic characteristic amount of an input sound, and the acoustic characteristic amount of a reference sound are stored, as input response history information, with being associated with one another. In addition, in the fifth embodiment, on the basis of the stored input response history information, correction corresponding to the audibility characteristic of the user and the ambient noise is performed.

<Configuration>

Figure 18:
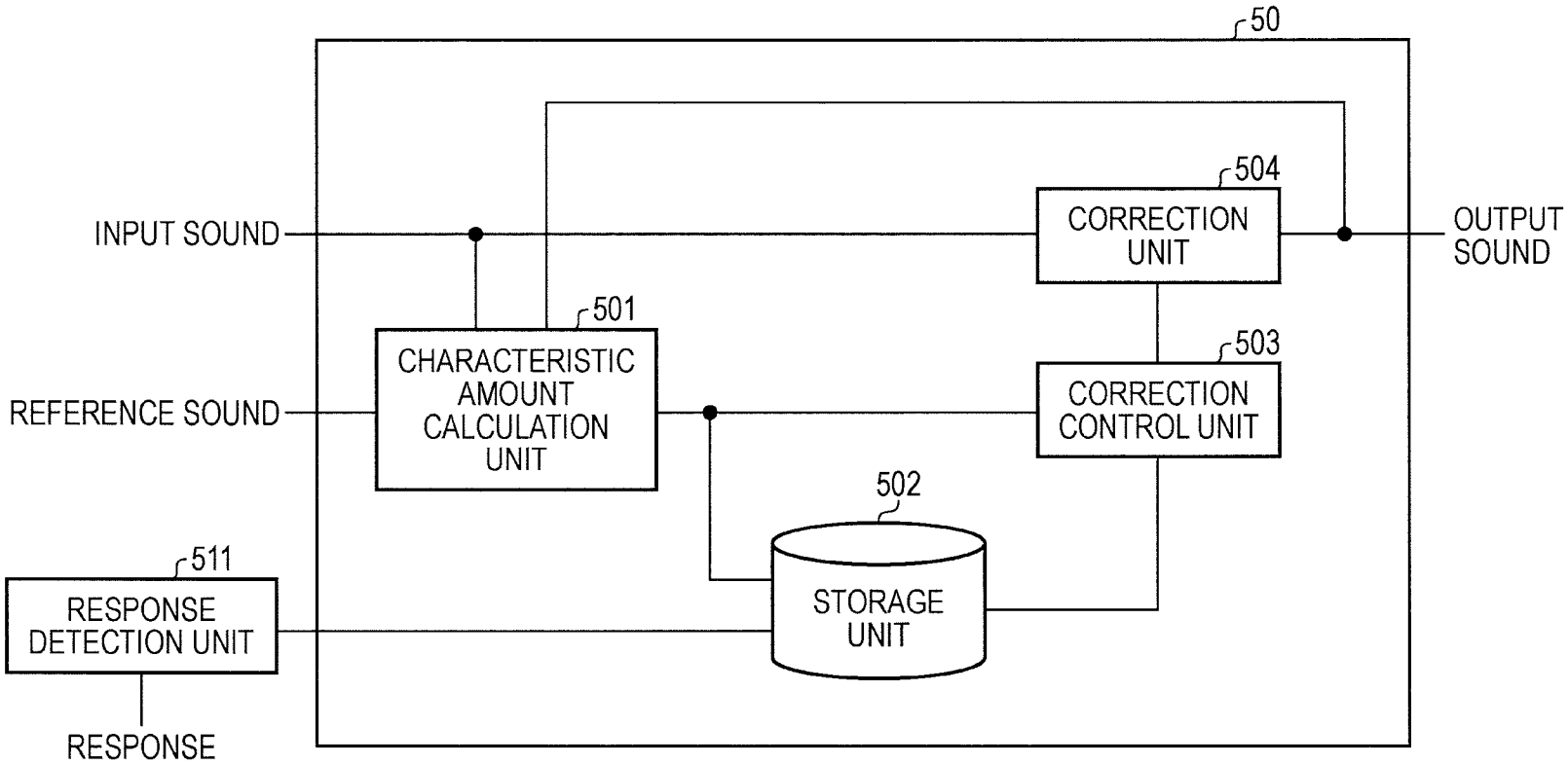
FIG. 18 is a block diagram illustrating an example of a configuration of a voice correction device in a fifth embodiment.

FIG. 18 is a block diagram illustrating an example of the configuration of a voice correction device 50 in the fifth embodiment. The voice correction device 50 includes a characteristic amount calculation unit 501, a storage unit 502, a correction control unit 503, and a correction unit 504. A response detection unit 511 is the same as the response detection unit 111 in the first embodiment, and may be included in the voice correction device 50.

The characteristic amount calculation unit 501 acquires processing frames (for example, corresponding to 20 ms) of an input sound, a reference sound, and an output sound (corrected input sound). The reference sound is a signal input from a microphone, and a signal including, for example, an ambient noise. The characteristic amount calculation unit 501 acquires the voice signals of the input sound and the reference sound, and calculates a first acoustic characteristic amount and at least one or more second acoustic characteristic amounts.

Hereinafter, the set of the numerical values of the above-mentioned at least one or more second acoustic characteristic amounts is referred to as a second acoustic characteristic amount vector. As described above, examples of the acoustic characteristic amount include the voice level of the input sound, the speaking speed of the input sound, the fundamental frequency of the input sound, the spectrum slope of the input sound, the Signal to Noise ratio (SNR) of the input sound, the ambient noise level of the reference sound, the SNR of the reference sound, a difference between the power of the input sound and the power of the reference sound, and the like.

The characteristic amount calculation unit 501 may use, as the first acoustic characteristic amount, one of the above-mentioned acoustic characteristic amounts, and may use, as the element of the second acoustic characteristic amount vector, at least one characteristic amount that is other than the same as the first acoustic characteristic amount, from among the above-mentioned acoustic characteristic amounts.

In the fifth embodiment, an acoustic characteristic amount selected as the first acoustic characteristic amount is the target of correction. For example, if the first acoustic characteristic amount is the voice level, the amplification processing or attenuation processing of the voice level of the input sound is performed in the correction unit 504.

For example, the characteristic amount calculation unit 501 calculates, as the first acoustic characteristic amount, a voice level illustrated in Expression (15) from the input sound and the output sound, and calculates, as the second acoustic characteristic amount, an ambient noise level illustrated in Expression (17) from the reference sound.

In addition, at this time, the characteristic amount calculation unit 501 determines whether or not the input sound and the reference sound are voices. The determination of whether or not the input sound and the reference sound are voices is performed using a technique of the related art. An example of such a technique is disclosed in Japanese Patent No. 3849116.

$$S(n) = \frac{1}{L}\sum_i IN_1(i)^2 \qquad \text{Expression (14)}$$

$$\bar{S}(n) = \begin{cases} \alpha S(n) + (1-\alpha)\bar{S}(n-1) & IN_1(\,) = \text{a voice} \\ \boxed{\bar{S}}(n-1) & IN_1(\,) \neq \text{a voice} \end{cases} \qquad \text{Expression (15)}$$

L: the number of samples per frame $LN_1O$: an input sound signal i: a sample number n: a frame number S(n): the frame power of a current input sound or a current output sound $\bar{S}(n)$: the voice level of an input sound or an output sound $$N(n) = \frac{1}{L}\sum_i IN_2(i)^2 \qquad \text{Expression (16)}$$

$$\bar{N}(n) = \begin{cases} \beta N(n) + (1-\beta)\bar{N}(n-1) & IN_2(\,) \neq \text{a voice} \\ \boxed{\bar{N}}(n-1) & IN_2(\,) = \text{a voice} \end{cases} \qquad \text{Expression (17)}$$

L: the number of samples per frame)

$IN_2(\,)$: a reference sound signal i: a sample number n: a frame number

N(n): the frame power of a current reference sound $\bar{N}(n)$: an ambient noise level In the fifth embodiment, since the number of the second acoustic characteristic amount is one, the second acoustic characteristic amount vector turns out to be a scalar value. The characteristic amount calculation unit 501 outputs the calculated voice level of the output sound and the ambient noise level of the reference sound to the storage unit 502.

The characteristic amount calculation unit 501 outputs the calculated voice level of the input sound and the ambient noise level of the reference sound to the correction control unit 503. When the input sound before the correction of the output sound is not a voice, the characteristic amount calculation unit 501 performs control so that outputting to the storage unit 502 is not performed.

The storage unit 502 saves therein the first acoustic characteristic amount and the second acoustic characteristic amount vector, calculated in the characteristic amount calculation unit 501, and the presence or absence of a user response within a predetermined time from the time of the detection of these characteristic amounts, with associating the first acoustic characteristic amount, the second acoustic characteristic amount vector, and the presence or absence of a user response with one another. The form of the save may be a form capable of referring to the number of occurrence of the user response and the frequency thereof with respect to the combination of individual characteristic amounts.

In the fifth embodiment, the storage unit 502 stores therein a relationship between the voice level of the output sound and the ambient noise level of the reference sound, calculated by the characteristic amount calculation unit 501, and the presence or absence of the user response. The storage unit 502 stores <the voice level of the output sound, the ambient noise level> calculated in the characteristic amount calculation unit 501, in a buffer along with a saved-in-buffer residual time (for example, several seconds).

With respect to each processing frame, the storage unit 502 decrements the saved-in-buffer residual time for each piece of data in the buffer, as the update of the saved-in-buffer residual time. The buffer may include capacity capable of holding an amount of data greater than or equal to a time lag between the user's hearing of the output sound and the user's response. For example, the buffer may be a buffer whose capacity capable of storing a processing frame for two or three seconds.

The storage unit 502 adds the information of "the absence of a response of the user" to data whose saved-in-buffer residual time has become less than or equal to "0", and stores, as input response history information, the information in the form of <the voice level of the output sound, an ambient noise level, the absence of a response of the user>. The data stored as the input response history information is removed from the buffer.

When a response signal has occurred from the response detection unit 511, the storage unit 502 adds the information of "the presence of a response of the user" to a predetermined piece of data existing within the buffer, stores, as the input response history information, the data in the form of <the voice level of the output sound, an ambient noise level, the presence of a response of the user>. When the data is stored as the input response history information, the storage unit 502 removes the stored data from the buffer.

Examples of the predetermined piece of data include the oldest data within the buffer, the average of data within the buffer, and the like.

The response detection unit 511 detects the response of the user, and outputs a response signal to the storage unit 502. Hereinafter, for the sake of convenience, it is assumed that the time of the response of the user is the same as the time of the output of the response signal, and a description will be given.

Figures 19, 20:
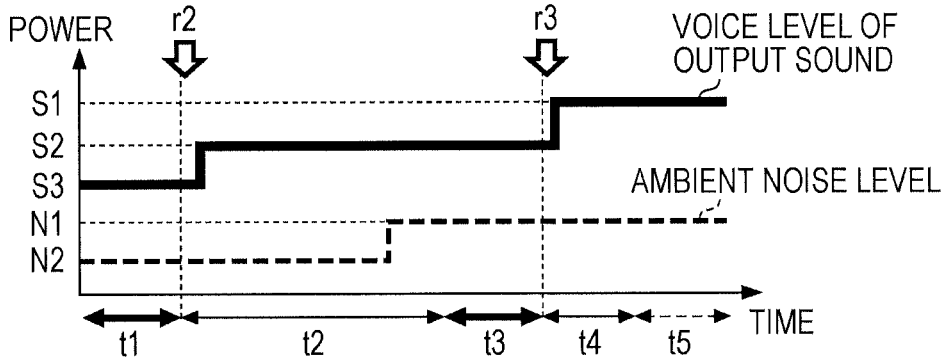
FIG. 19 is a diagram illustrating an example of a relationship between a voice level of an output sound, an ambient noise level, and a time.
FIG. 20 is a diagram illustrating an example of input response history information.

Here, using FIG. 19, registration in the storage unit 502 will be described. FIG. 19 is a diagram illustrating an example of a relationship between the voice level of an output sound, an ambient noise level, and a time. When the response of a user has occurred at the timing of r2 illustrated in FIG. 19, the storage unit 502 stores, as input response history information, the acoustic characteristic amount of each processing frame of an input sound existing within a saved-in-buffer residual time (t1).

At this time, the storage unit 502 stores, as <S3, N2, presence>, an input response history <the voice level of an output sound, an ambient noise level, the presence or absence of a response> in the input response history information with the voice level of an output sound, the ambient noise level, and the presence or absence of a response being bundled with one another.

As for the response of the user at the timing of r3, in the same way, the storage unit 502 also stores an input response history in the input response history information with defining the presence or absence of a response as "presence" in such a way as <S2, N1, presence>, with respect to each processing frame existing within a saved-in-buffer residual time (t3).

With respect to an interval (t2, t4) where no user response exists within the saved-in-buffer residual time, the storage unit 502 stores an input response history in the input response history information with defining the presence or absence of a response as "absence" in such a way as <S2, N2, absence>. For example, in an interval t2, a plurality of intervals whose times corresponding to a saved-in-buffer residual time exist.

The interval of t5 illustrated in FIG. 19 is an interval where a saved-in-buffer residual time is greater than or equal to "0" and no corresponding user response exists, and the interval of t5 indicates a state in which buffering is performed.

FIG. 20 is a diagram illustrating an example of the input response history information. As illustrated in FIG. 20, the voice level of an output sound, an ambient noise level, and the presence or absence of a response are stored, as the input response history information, in the storage unit 502. For example, a level illustrated in FIG. 20 is the average value of data corresponding to a saved-in-buffer residual time or the average value of data stored until the occurrence of the response of the user.

Returning to FIG. 18, the correction control unit 503 acquires an acoustic characteristic amount calculated by the characteristic amount calculation unit 501, and compares the acquired acoustic characteristic amount with input response history information stored in the storage unit 502, thereby calculating a correction amount.

The correction control unit 503 refers to the input response history information from the storage unit 502, the input response history information being calculated by the characteristic amount calculation unit 501 and having the same vector as the second acoustic characteristic amount vector of a reference sound. In addition, the correction control unit 503 estimates the first acoustic characteristic amount causing the frequency of occurrence of a signal in which indistinctness for the user is reflected to be reduced. The correction control unit 503 determines a target correction amount on the basis of the estimated first acoustic characteristic amount.

In addition, at the determination of the coincidence of the vector, the correction control unit 503 may calculate a distance between the two vectors and determine that the two vectors match each other, when the distance is small. Examples of the distance between vectors include a Euclidean distance, a standard Euclidean distance, a Manhattan distance, a Mahalanobis distance, a Chebyshev distance, a Minkowski distance, and the like. At the time of the calculation of a distance between vectors, weighting may be performed on the individual elements of the vectors.

After having set the target correction amount, the correction control unit 503 compares the first acoustic characteristic amount of an input sound with the target correction amount, thereby determining a correction amount.

In the fifth embodiment, the correction control unit 503 compares an ambient noise level $N_{in}$ calculated by the characteristic amount calculation unit 501 with an ambient noise level $N_{hist}$ included the input response history information. As a comparison result, the correction control unit 503 extracts, from the storage unit 502, the input response history information satisfying Expression (18).

$$|N_{hist}-N_{in}|\leq TH1 \qquad \text{Expression (18)}$$

$N_{in}$: the ambient noise level of a current frame $N_{hist}$: an ambient noise level included in an input response history TH1: a range in which the two ambient noise levels are regarded as the same noise level (for example, 5 dB)

FIG. 21 is a diagram illustrating an example of the extracted input response history information. In the example illustrated in FIG. 21, an ambient noise level "N1" satisfying Expression (18) is extracted by the correction control unit 503 from the input response history information illustrated in FIG. 20. This means that the ambient noise level of a processing frame is equal to the N1 level.

Using the extracted input response history information, the correction control unit 503 estimates the listenability of the voice level of each output sound with respect to a current ambient noise level. The correction control unit 503 calculates the probability of "the absence of the response of a user" with respect to each value of the voice level, and calculates the probability as the estimation value of the listenability (hereinafter, referred to as an intelligibleness value).

The correction control unit 503 sets, as a target correction amount, the voice level of an output sound whose intelligibleness value is greater than or equal to a predetermined value. For example, it is assumed that the predetermined value is 0.95. The correction control unit 503 outputs, to the correction unit 504, a difference between the voice level of an input sound, calculated by the characteristic amount calculation unit 501, and the obtained target correction amount, as a correction amount.

In addition, when the intelligibleness value with respect to the voice level of the input sound has already been greater than or equal to the predetermined value, the correction amount may be set to "0", for example. Next, as an example, a case will be cited in which the ambient noise level of the reference sound of a current processing frame is $N_{in}$, and correction amount calculation processing will be described.

(Correction Amount Calculation Processing)

It is assumed that input response history information sufficient for the calculation of a correction amount is stored in the storage unit 502. First, the correction control unit 503 extracts data satisfying Expression (18) from the storage unit 502 (refer to FIG. 21).

The correction control unit 503 counts "the number of presences in the presence or absence of a response" and "the number of absences in the presence or absence of a response" with respect to each voice level of the output sound in the extracted data, and expresses the number as num(the voice level of an output sound, the presence or absence of a response).

For example, when 50 pieces of input response history information, in each of which <the voice level of an output sound, an ambient noise level, the presence or absence of a response>=<S1, *, presence>, are included in the extracted input response history information, it turns out that a num(S1, presence)=50.

Next, the correction control unit 503 calculates, as an intelligibleness value, a frequency num(S1, absence) in which the presence or absence of a response is an absence, with respect to each value of the voice level of an output sound. The correction control unit 503 obtains an intelligibleness value p(S1) for the voice level S1 of the output sound on the basis of Expression (19).

$$p(S1)=\text{num}(S1,\text{absence})/(\text{num}(S1,\text{absence})+\text{num}(S1,\text{presence})) \quad \text{Expression (19)}$$

p(x): an intelligibleness value with respect to x

S1: the voice level of the output sound num(x, f): the number of pieces of input response history information where the value of the voice level of the output sound is x and the presence or absence of a response is f The correction control unit 503 calculates a correction amount using the calculated intelligibleness value p(S). The correction amount calculation processing will be described using FIGS. 22A to 22C. $S_{in}$ illustrated in FIGS. 22A to 22C indicates the voice level of an input sound.

Figure 22A:
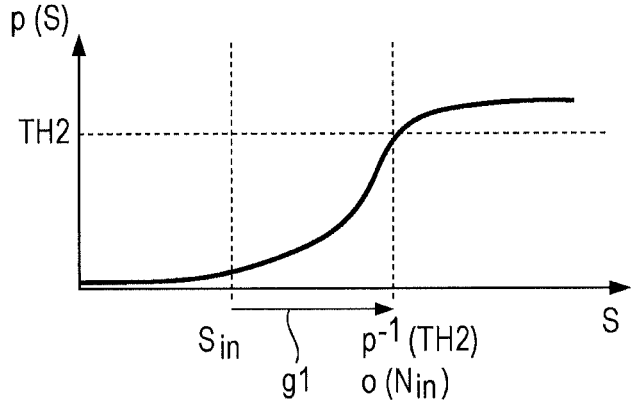
FIGS. 22A to 22C are diagrams illustrating examples of a relationship between a voice level of an output sound and an intelligibleness value.

FIG. 22A is a diagram illustrating an example of a relationship (1) between the voice level S of an output sound and an intelligibleness value p(S). First, when the intelligibleness value is higher than a predetermined threshold value TH2 (for example, 0.95), it may be determined that an output sound at that time is fully easily heard.

The correction control unit 503 sets, to a target correction amount, the value of a voice level whose intelligibleness value is the threshold value TH2. For example, the correction control unit 503 sets an intelligibleness value $p^{-1}(TH2)$ as a target correction amount $o(N_{in})$ for the ambient noise level $N_{in}$. If correcting the voice level $S_{in}$ of the input sound so that the voice level $S_{in}$ becomes a target correction amount at the time of the ambient noise level $N_{in}$, the correction unit 504 may correct a voice so that the user easily hears the voice.

Figure 22B:
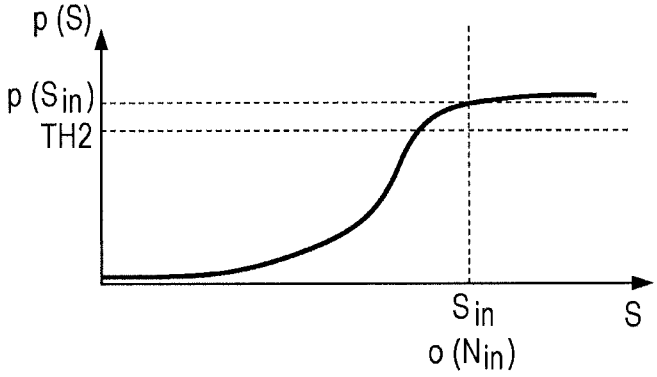

FIG. 22B is a diagram illustrating an example of a relationship (2) between the voice level S of the output sound and the intelligibleness value p(S). The relationship illustrated in FIG. 22B corresponds to a case in which $p(S_{in})>TH2$ is satisfied. In the case illustrated in FIG. 22B, the correction control unit 503 sets the $S_{in}$ to the target correction amount $o(N_{in})$.

Figure 22C:
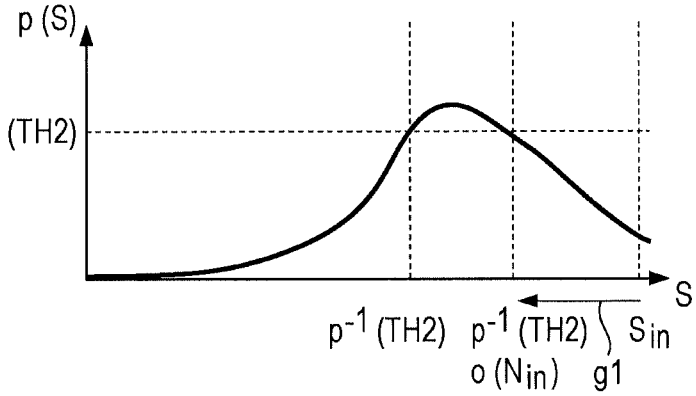

FIG. 22C is a diagram illustrating an example of a relationship (3) between the voice level S of the output sound and the intelligibleness value p(S). The relationship illustrated in FIG. 22C corresponds to a case in which there are a plurality of $p^{-1}(TH2)$. In the case illustrated in FIG. 22C, the correction control unit 503 sets, to the target correction amount $o(N_{in})$, a value from among the solutions of $p^{-1}(TH2)$, which is nearest to the $S_{in}$.

Accordingly, the correction control unit 503 sets the target correction amount $o(N_{in})$ on the basis of Expression (20).

$$o(N_{in})\begin{cases} p^{-1}(TH2) & (p(S_{in})<TH2,\ \min(|p^{-1}(TH2)-S_{in}|)) \\ S_{in} & (p(S_{in})\geq TH2) \end{cases} \quad \text{Expression (20)}$$

o(x): a target correction amount when an ambient noise level is x $p^{-1}(y)$: the inverse function of Expression (19)

$S_{in}$: the voice level of an input sound

TH2: a threshold value used for determining intelligibleness (for example, 0.95)

When the target correction amount is determined on the basis of Expression (20), the correction control unit 503 calculates a correction amount g on the basis of Expression (21).

$$g=o(N_{in})-S_{in} \quad \text{Expression (21)}$$

g: a correction amount (in units of dB (decibel))

o(x): a target correction amount when an ambient noise level is x $S_{in}$: the voice level of an input sound The correction control unit 503 outputs the calculated correction amount g to the correction unit 504.

Returning to FIG. 18, the correction unit 504 amplifies or attenuates the voice level of the input sound on the basis of the correction amount g acquired from the correction control unit 503. The correction unit 504 outputs the voice signal (output sound) corrected in accordance with Expression (22).

$$\text{OUT}(i)=g*\text{IN}_1(i) \quad \text{Expression (22)}$$

$IN_1(\ )$: an input sound signal i: a sample number

OUT( ): an output sound signal

Accordingly, it is possible to correct a voice so that the voice becomes intelligible and suited for the audibility characteristic of the user, in accordance with an ambient noise.

<Operation>

Figure 23:
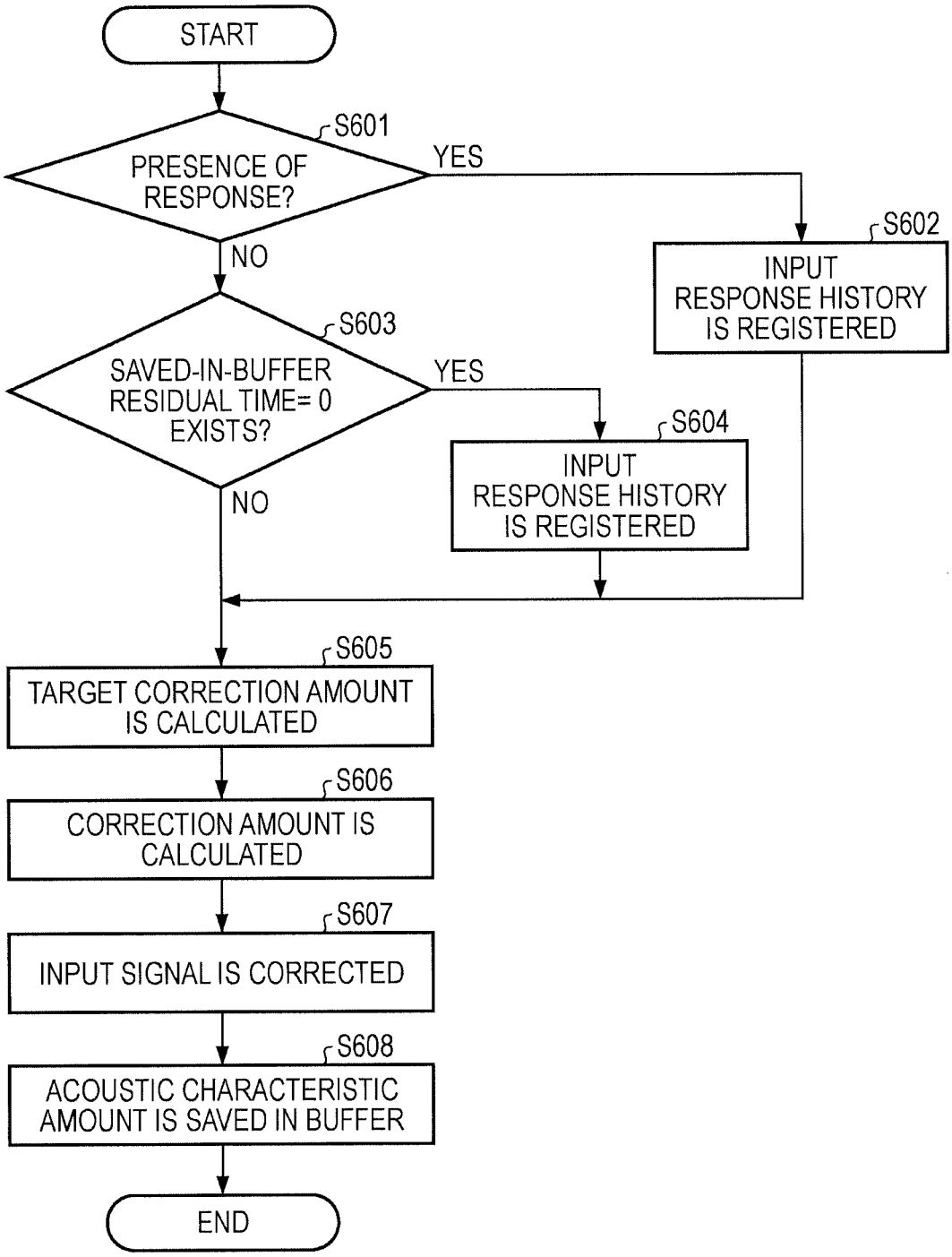
FIG. 23 is a flowchart illustrating an example of voice correction processing in the fifth embodiment.

Next, the operation of the voice correction device 50 in the fifth embodiment will be described. FIG. 23 is a flowchart illustrating an example of the voice correction processing in the fifth embodiment. In Step S601 illustrated in FIG. 23, the storage unit 502 determines whether or not a response has occurred from a user. When the response occurs from the user (Step S601: YES), the processing proceeds to Step S602. In addition, when no response occurs from the user (Step S601: NO), the processing proceeds to Step S603.

In Step S602, the storage unit 502 assigns the presence of a response to the data set of individual acoustic characteristic amounts stored in the buffer, stores the data as input response history information, and removes the stored data from the buffer.

In Step S603, the storage unit 502 decrements a saved-in-buffer residual time associated with the individual acoustic characteristics stored in the buffer, and determines whether or not there is data whose saved-in-buffer residual time has become "0". When there is data whose residual time is "0" (after a predetermined time has elapsed) (Step S603: YES), the processing proceeds to Step S604. In addition, when there is not data whose residual time is "0" (Step S603: NO), the processing proceeds to Step S605.

In Step S604, the storage unit 502 assigns the absence of a response to the data whose residual time is "0" from among the data sets of individual acoustic characteristic amounts stored in the buffer, stores the data as input response history information, and removes the stored data from the buffer.

In Step S605, the correction control unit 503 calculates a target correction amount on the basis of the input response history information stored in the storage unit 502 and the ambient noise level calculated in the characteristic amount calculation unit 501. The calculation of the target correction amount is as described above.

In Step S606, the correction control unit 503 compares the target correction amount calculated in Step S605 with the voice level of the input sound calculated in the characteristic amount calculation unit 501, thereby calculating a correction amount.

In Step S607, the correction unit 504 corrects an input sound in response to the correction amount calculated in the correction control unit 503.

In Step S608, the storage unit 502 stores, in the buffer, the voice level of a current frame after correction, calculated by the characteristic amount calculation unit 501, and an ambient noise level. In this regard, however, when it is determined that the current frame of the input sound is not a voice, the characteristic amount calculation unit 501 does not perform buffering. Here, the user makes a response to the output sound. Therefore, the voice level of the input sound is not stored in the buffer but the voice level of the output sound is stored in the buffer.

As described above, according to the fifth embodiment, on the basis of the simple response of the user, it is possible to correct a voice so that the voice becomes intelligible and suited for the audibility characteristic of the user, in accordance with an ambient noise.

Sixth Embodiment

Next, a voice correction device 60 in the sixth embodiment will be described. In the sixth embodiment, an ambient noise level and a signal-noise ratio (SNR) are calculated, as the second acoustic characteristic amounts, from a reference sound and an input sound, respectively. In addition, in the sixth embodiment, the storage area of the storage unit is reduced compared with the fifth embodiment.

<Configuration>

Figure 24:
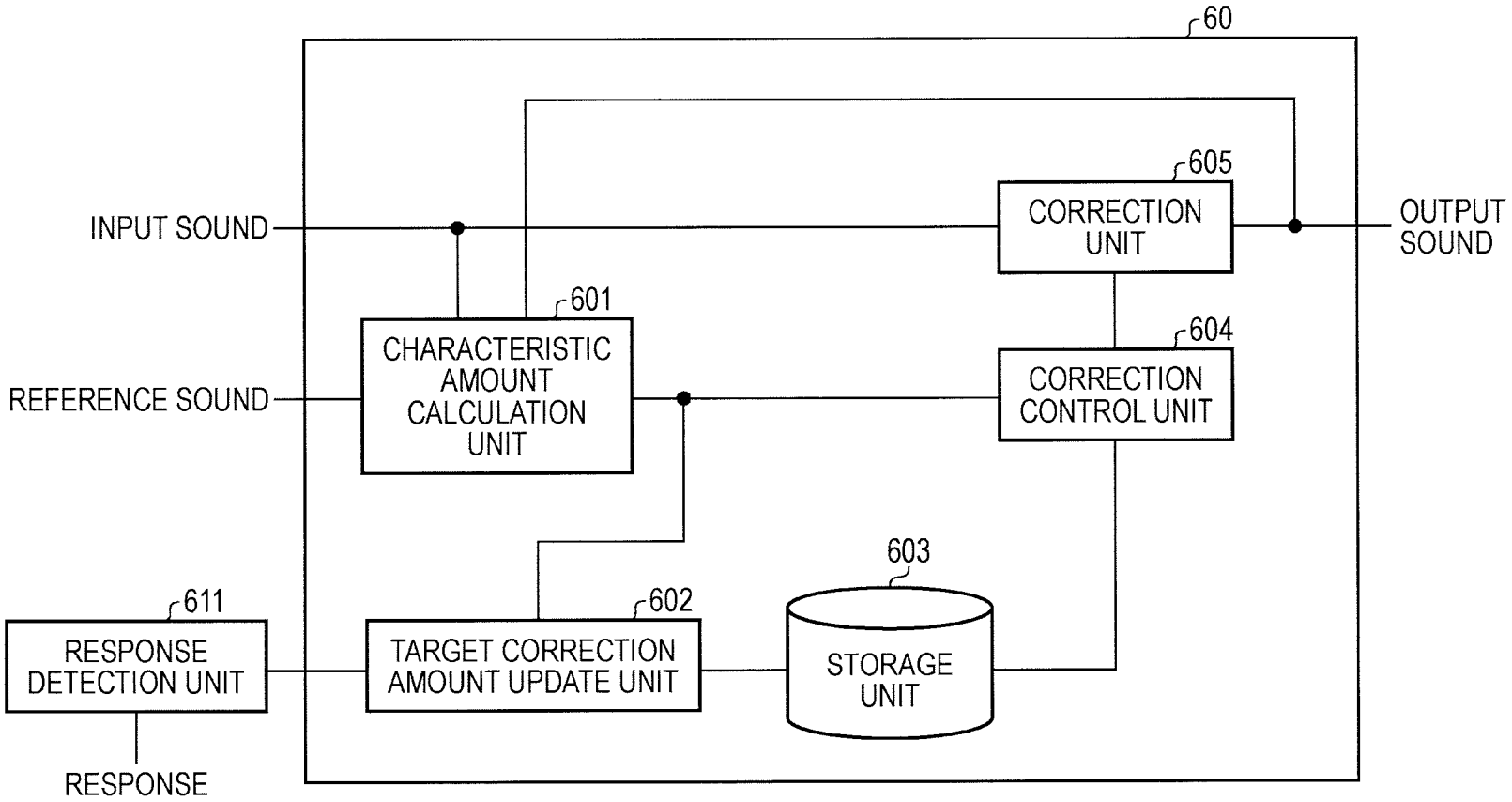
FIG. 24 is a block diagram illustrating an example of a configuration of a voice correction device in a sixth embodiment.

FIG. 24 is a block diagram illustrating an example of the configuration of the voice correction device 60 in the sixth embodiment. The voice correction device 60 includes a characteristic amount calculation unit 601, a target correction amount update unit 602, a storage unit 603, a correction control unit 604, and a correction unit 605. A response detection unit 611 is the same as the response detection unit 111 in the first embodiment, and may be included in the voice correction device 60.

The characteristic amount calculation unit 601 acquires processing frames (for example, corresponding to 20 ms) of an input sound, a reference sound, and an output sound (corrected input sound). The characteristic amount calculation unit 601 calculates, as the first acoustic characteristic amount, a voice level illustrated in Expression (15) from an input sound and an output sound, and calculates, as the second acoustic characteristic amounts, an ambient noise level illustrated in Expression (17) from a reference sound and an SNR illustrated in Expression (25) from the input sound. In addition, the characteristic amount calculation unit 601 determines whether or not the input sound is a voice.

$$N2(n) = \frac{1}{L}\sum_i IN_1(i)^2 \qquad \text{Expression (23)}$$

$$\overline{N2}(n) = \begin{cases} \gamma N(n) + (1+\gamma)\overline{N2}(n-1) & IN_1(\,) \neq \text{a voice} \\ \boxed{N}2(n-1) & IN_1(\,) = \text{a voice} \end{cases} \qquad \text{Expression (24)}$$

$$SNR(n) = \frac{\overline{S}(n)}{\overline{N2}(n)} \qquad \text{Expression (25)}$$

L: the number of samples per frame $IN_1(\,)$: an input sound signal i: a sample number n: a frame number N2(*n*): the frame power of a current input sound $\overline{N2}$(n): a noise level SNR(n): the SNR of an input sound In the sixth embodiment, the second acoustic characteristic amount vector turns out to be <an ambient noise level, an SNR>. The characteristic amount calculation unit 601 outputs the voice level of the output sound and <an ambient noise level, an SNR>, which have been calculated, to the target correction amount update unit 602, and outputs the voice level of the input sound and <an ambient noise level, an SNR> to the correction control unit 604. When the input sound is not a voice, the characteristic amount calculation unit 601 performs control so that outputting to the target correction amount update unit 602 is not performed.

The target correction amount update unit 602 stores the data set of <a voice level, <an ambient noise level, and SNR>> calculated by the characteristic amount calculation unit 601 in a buffer capable of storing a predetermined number of sets. When the response of a user has occurred, the target correction amount update unit 602 adds the information of "the presence of the response of a user" to a predetermined piece of data within the buffer and outputs the data to the storage unit 603.

In addition, for example, the predetermined piece of data is the oldest data. In addition, taking a time lag from the occurrence of a response into consideration, the buffer may include a storage area of about one to three seconds, for example.

The storage unit 603 divides the values of the acoustic characteristic amounts, input from the characteristic amount calculation unit 601, into the ranks of several stages. To one rank, the acoustic characteristic amount of a predetermined range (for example, 5 dB) is assigned. The ranks of the voice level, the ambient noise level, and the SNR are obtained on the basis of Expressions (26) to (28).

$$Sr(n) = \left[\frac{(\overline{S}(n) - S_{min})}{S_{max} - S_{min}} * Rs\right] \quad \text{Expression (26)}$$

$$Nr(n) = \left[\frac{(\overline{N}(n) - N_{min})}{N_{max} - N_{min}} * Rn\right] \quad \text{Expression (27)}$$

$$SNRr(n) = \left[\frac{(\overline{SNR}(n) - SNR_{min})}{SNR_{max} - SNR_{min}} * Rsnr\right] \quad \text{Expression (28)}$$

[x]: a maximum integer number not exceeding x

Sr(n): a voice level rank $S_{min}$: a minimum value of a voice level $S_{max}$: a maximum value of a voice level Rs: the number of ranks of voice levels Nr(n): an ambient noise level rank $N_{min}$: a minimum value of an ambient noise level $N_{max}$: a maximum value of an ambient noise level Rn: the number of ranks of ambient noise levels SNRr(n): an SNR rank $SNR_{min}$: a minimum value of an SNR $SNR_{max}$: a maximum value of an SNR Rsnr: the number of ranks of SNRs The storage unit 603 has two counters with respect to each of all the combinations of the ranks of the first acoustic characteristic amount and the second acoustic characteristic amount vector. The storage unit 603 records the number of the "presence" of a user response and the number of the "absence" of a user response in each of the combinations of the ranks of the first acoustic characteristic amount and the second acoustic characteristic amount vector. The counter may be realized using an array of Rs*Rn*Rsnr*2.

FIG. 25 is a diagram illustrating an example of pieces of combination information with respect to the ranks of the first acoustic characteristic amount and the second acoustic characteristic amount vector. As illustrated in FIG. 25, the storage unit 603 stores therein the number of the presence or absence of a response with respect to each of the rank of the voice level and the rank of <an ambient noise level, an SNR>.

Accordingly, since the number is counted with respect to each rank having a predetermined range, it is possible to reduce the storage area of the storage unit 603 compared with a case in which the presence or absence of a response is recorded with respect to each history.

The target correction amount update unit 602 acquires, from the storage unit 603, the value of a counter having the same value as that of <an ambient noise level rank, an SNR rank> acquired from the characteristic amount calculation unit 601 and registered in the storage unit 603. Using Expression (29), the target correction amount update unit 602 calculates an intelligibleness value with respect to each rank of the acquired voice level.

$$p(Sr, \langle Nr, SNRr\rangle) = \text{num}(Sr, \langle Nr, SNRr\rangle, \text{absence})/(\text{num}(Sr, \langle Nr, SNRr\rangle, \text{presence}) + \text{num}(Sr, \langle Nr, SNRr\rangle, \text{absence})) \quad \text{Expression (29)}$$

p(Sr, <Nr, SNRr>): an intelligibleness value with respect to a voice level rank and <an ambient noise level rank, an SNR rank> num(Sr, <Nr, SNRr>, absence): the number of times no user response has occurred with respect to a voice level rank and <an ambient noise level rank, an SNR rank> num(Sr, <Nr, SNRr>, presence): the number of times a user response has occurred with respect to a voice level rank and <an ambient noise level rank, an SNR rank>

The target correction amount update unit 602 obtains a minimum voice level rank where an intelligibleness value is greater than or equal to a predetermined value TH3, on the basis of Expression (30).

$$o_r(\langle Nr, SNRr\rangle) = \min(p^{-1}(TH3)) \quad \text{Expression (30)}$$

o(<Nr, SNRr>): a target correction amount with respect to <an ambient noise level rank, an SNR rank>

TH3: a threshold value used for determining intelligibleness (for example, 0.95)

The target correction amount update unit 602 converts the obtained voice level rank into a voice level on the basis of Expression (31), and stores the voice level in the storage unit 603, as a target correction amount with respect to <an ambient noise level rank, an SNR rank>.

$$o(\langle Nr, SNRr\rangle) = (o_r(\langle Nr, SNRr\rangle) * (S_{max} - S_{min}))/Rs + S_{min} \quad \text{Expression (31)}$$

Nr: an ambient noise level rank

SNRr: an SNR rank $S_{min}$: a minimum value of a voice level $S_{max}$: a maximum value of a voice level Rs: the number of ranks of voice levels FIG. 26 is a diagram illustrating an example of the target correction amount in the sixth embodiment. As illustrated in FIG. 26, the storage unit 603 stores therein the target correction amount of a voice level in response to an SNR rank and an ambient noise level rank. For example, the target correction amount update unit 602 updates the target correction amount periodically (for example, every one minute). The update of the target correction amount may be performed at timing different from the update of the combination information illustrated in FIG. 25.

Returning to FIG. 24, the correction control unit 604 acquires, from the storage unit 603, a target correction amount for <an ambient noise level rank, an SNR rank> of a current frame. On the basis of Expression (32), the correction control unit 604 compares the target correction amount with the voice level $S_{in}$ of an input sound, thereby calculating the correction amount g.

$$g = \begin{cases} o(\langle Nr_{in}, SNRr_{in}\rangle) - S_{in} & o(\langle Nr_{in}, SNRr_{in}\rangle) \geq S_{in} \\ 0 & o(\langle Nr_{in}, SNRr_{in}\rangle) < S_{in} \end{cases} \quad \text{Expression (32)}$$

$Nr_{in}$: the ambient noise level rank of a reference sound $SNRr_{in}$: the SNR rank of an input sound $S_{in}$: the voice level of an input sound g: a correction amount The correction unit 605 outputs a voice signal corrected in accordance with Expression (22).

<Operation>

Figure 27:
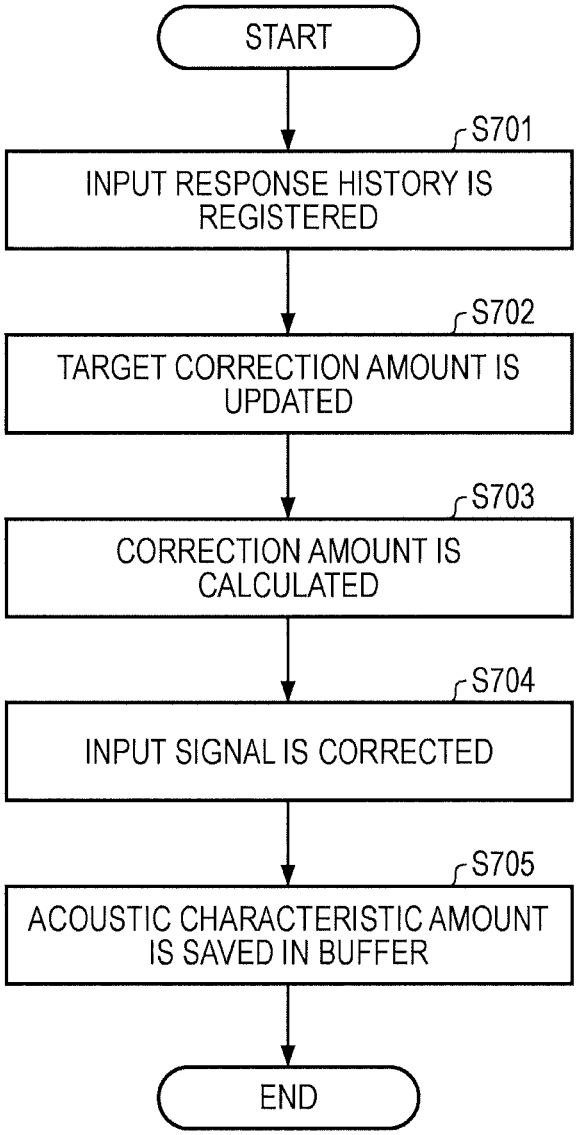
FIG. 27 is a flowchart illustrating an example of voice correction processing in the sixth embodiment.

Next, the operation of the voice correction device 60 in the sixth embodiment will be described. FIG. 27 is a flowchart illustrating an example of the voice correction processing in the sixth embodiment. In Step S701 illustrated in FIG. 27, the target correction amount update unit 602 determines whether or not a response has occurred from a user.

When a response occurs from the user, the target correction amount update unit 602 assigns the presence of a user response to the oldest data set of acoustic characteristic amounts within the buffer, and stores, as input response history information, the data in the storage unit 603, for example.

In addition, when no response occurs from the user, the target correction amount update unit 602 assigns the absence of a user response to the oldest data set of acoustic characteristic amounts within the buffer, and stores, as input response history information, the data in the storage unit 603. When no response occurs from the user, the target correction amount update unit 602 may average and store a predetermined acoustic characteristic amount within the buffer or the data set of acoustic characteristic amounts within the buffer in the storage unit 603.

In Step S702, the target correction amount update unit 602 refers to input response history information having the same <an ambient noise level rank, an SNR rank> as that of the data set stored in the storage unit 603 in Step S701. Using the referred-to input response history information, the target correction amount update unit 602 updates a target correction amount for <an ambient noise level rank, an SNR rank>.

In Step S703, the correction control unit 604 acquires, from the storage unit 603, a target correction amount for <an ambient noise level rank, an SNR rank> of a current frame, and compares the voice level of the current frame with the target correction amount, thereby calculating a correction amount.

In Step S704, the correction unit 605 corrects an input sound in response to the correction amount calculated in Step S703.

In Step S705, the target correction amount update unit 602 stores, in the buffer, the voice level of a current frame after correction, an SNR, an ambient noise level. In this regard, however, when it is determined that the current frame of the input sound is not a voice, the characteristic amount calculation unit 601 performs control so that the storage in the buffer is not performed.

As described above, according to the sixth embodiment, on the basis of the simple response of the user, it is possible to cause a voice to be easily heard in accordance with the audibility characteristic of the user, an ambient noise, and an SNR. In addition, according to the sixth embodiment, by adjusting the division rank of each acoustic characteristic amount, it is possible to only implement a small storage capacity.

Seventh Embodiment

Next, a voice correction device 70 in a seventh embodiment will be described. In the seventh embodiment, as the first acoustic characteristic amount, a speaking speed is calculated. In addition to this, as the second acoustic characteristic amounts, a fundamental frequency is calculated, an ambient noise level is calculated from a reference sound, and an SNR is calculated from an input sound. In addition, in the seventh embodiment, asking in reply is used as a user response.

<Configuration>

Figure 28:
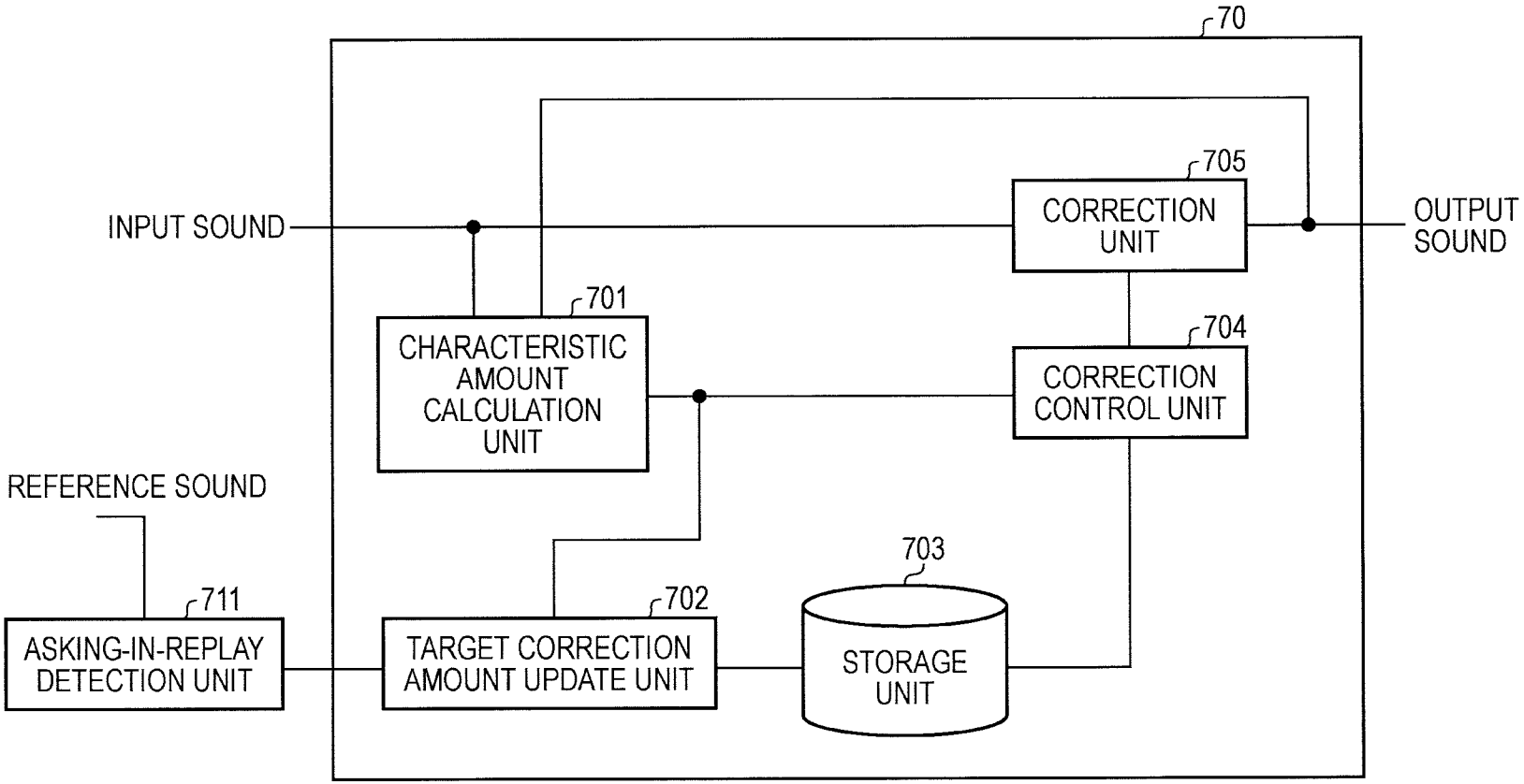
FIG. 28 is a block diagram illustrating an example of a configuration of a voice correction device in a seventh embodiment.

FIG. 28 is a block diagram illustrating an example of the configuration of the voice correction device 70 in the seventh embodiment. The voice correction device 70 includes a characteristic amount calculation unit 701, a target correction amount update unit 702, a storage unit 703, a correction control unit 704, and a correction unit 705. In addition, while being equipped with an asking-in-reply detection unit 711 located on the outside thereof, the voice correction device 70 may include therein the asking-in-reply detection unit 711.

The asking-in-reply detection unit 711 detects the user's asking in reply, from a reference sound. An asking-in-reply detection method is performed using a technique of the related art. An example of such a technique is disclosed in Japanese Laid-open Patent Publication No. 2008-278327. In addition, when an utterance interval length is small, the voice level of an utterance interval increases, and the fluctuation of a pitch in the utterance interval is large, the asking-in-reply detection unit 711 may determine that asking in reply occurs.

The characteristic amount calculation unit 701 acquires the processing frame of an input sound (for example, 20 ms). The characteristic amount calculation unit 701 calculates a speaking speed illustrated in Expression (33) and a fundamental frequency illustrated in Expression (34), as the first acoustic characteristic amount and the second acoustic characteristic amount, respectively.

Here, the speaking speed and the fundamental frequency are combined. This is because there is a phenomenon that, even if a physical speaking speed is same, a person subjectively feels the speaking speed to be fast with an increase in a fundamental frequency F0. Accordingly, in order to cause a speaking speed to be subjectively adequate, the speaking speed may be adjusted with respect to each fundamental frequency. In addition, the characteristic amount calculation unit 701 determines whether or not an input sound is a voice.

$$\overline{M}(n) = \begin{cases} \delta M(n) + (1-\delta)\overline{M}(n-1) & IN_1(\,) \neq \text{a voice} \\ \overline{M}(n-1) & IN_1(\,) = \text{a voice} \end{cases} \quad \text{Expression (33)}$$

$IN_1(\,)$: an input sound signal n: a frame number

M(n): the speaking speed (mora) of a current frame, obtained from $IN_1(\,)$ $\overline{M}$(n): a speaking speed $$\overline{F0}(n) = \begin{cases} \varepsilon F0(n) + (1-\varepsilon)\overline{F0}(n-1) & IN_1(\,) \neq \text{a voice} \\ \overline{\delta F0}(n-1) & IN_1(\,) = \text{a voice} \end{cases} \quad \text{Expression (34)}$$

$IN_1(\,)$: an input sound signal n: a frame number

F0(*n*): the fundamental frequency (Hz) of a current frame, obtained from $IN_1(\,)$ $\overline{F0}$(n): a fundamental frequency The characteristic amount calculation unit 701 outputs the calculated speaking speed and the calculated fundamental frequency of an output sound to the target correction amount update unit 702, and outputs the speaking speed and the fundamental frequency of an input sound to the correction control unit 704. When the input sound is not a voice, the characteristic amount calculation unit 701 performs control so that outputting to the target correction amount update unit 702 is not performed.

The storage unit 703 stores therein the intelligibility p (a speaking speed, a fundamental frequency) of the speaking speed with respect to each fundamental frequency. It is assumed that an initial intelligibility is 1. The intelligibility is a variable used for obtaining an intelligible speaking speed.

FIG. 29 is a diagram illustrating an example of intelligibility with respect to a fundamental frequency rank and a speaking speed rank. As illustrated in FIG. 29, the storage unit 703 stores therein the intelligibility with respect to the fundamental frequency rank and the speaking speed rank. The intelligibility is calculated by the target correction amount update unit 702.

In addition, in the storage unit 703 in the seventh embodiment, the acoustic characteristic amount is also stored with respect to each rank indicating such a predetermined range as described in the sixth embodiment. Accordingly, the fundamental frequency is ranked with respect to each predetermined Hz, and the speaking speed is ranked with respect to each predetermined unit.

Returning to FIG. 28, when having detected the response (asking in reply) of the user, the target correction amount update unit 702 multiplies the intelligibility of <a speaking speed, a fundamental frequency> calculated by the characteristic amount calculation unit 701 by a penalty in accordance with Expression (35).

$$p(\overline{M}(n),\overline{F0}(n))=p(\overline{M}(n),\overline{F0}(n))\times\theta \qquad \text{Expression (35)}$$

p(a speaking speed, a fundamental frequency): intelligibility with respect to a speaking speed and a fundamental frequency $\overline{M}$(n): a speaking speed $\overline{F0}$(n): a fundamental frequency θ: a penalty (for example, 0.9)

With respect to each predetermined frame in which there is not the user's asking in reply, the target correction amount update unit 702 multiplies the intelligibility of <a speaking speed, a fundamental frequency> calculated by the characteristic amount calculation unit 701 by a score in accordance with Expression (36).

$$p(\overline{M},\overline{F0})=p(\overline{M},\overline{F0})\times\theta' \qquad \text{Expression (36)}$$

p(a speaking speed, a fundamental frequency): intelligibility with respect to a speaking speed and a fundamental frequency $\overline{M}$(n): a speaking speed $\overline{F0}$(n): a fundamental frequency θ': a score (for example, 1.01)

Every time the intelligibility in the storage unit 703 is updated, the target correction amount update unit 702 updates the target correction amount of a speaking speed with respect to a fundamental frequency in accordance with Expression (37).

$$o(F0)=\min(p^{-1}(TH4,F0)) \qquad \text{Expression (37)}$$

o(a fundamental frequency): a target correction amount with respect to a fundamental frequency TH4: a threshold value used for determining intelligibleness (for example, 1.0)

FIG. 30 is a diagram illustrating an example of a target correction amount in the seventh embodiment. As illustrated in FIG. 30, the storage unit 703 stores the target correction amount of a speaking speed with associating the target correction amount of a speaking speed with a fundamental frequency rank.

Returning to FIG. 28, the correction control unit 704 acquires, from the storage unit 703, a target correction amount for the fundamental frequency $F0_{in}$ of a current frame, and calculates a correction amount m for the speaking speed $M_{in}$ of the input sound in accordance with Expression (38).

$$m=\begin{cases} o(F0_{in})/M_{in} & p(F0_{in})<TH4 \\ 1 & p(F0_{in})\geq TH4 \end{cases} \qquad \text{Expression (38)}$$

The correction unit 705 converts the speaking speed of the input sound in accordance with the correction amount calculated by the correction control unit 704 and outputs the input sound. The conversion of the speaking speed is performed using a technique of the related art. (An example of such a technique is disclosed in Japanese Patent No. 3619946.)

<Operation>

Figure 31:
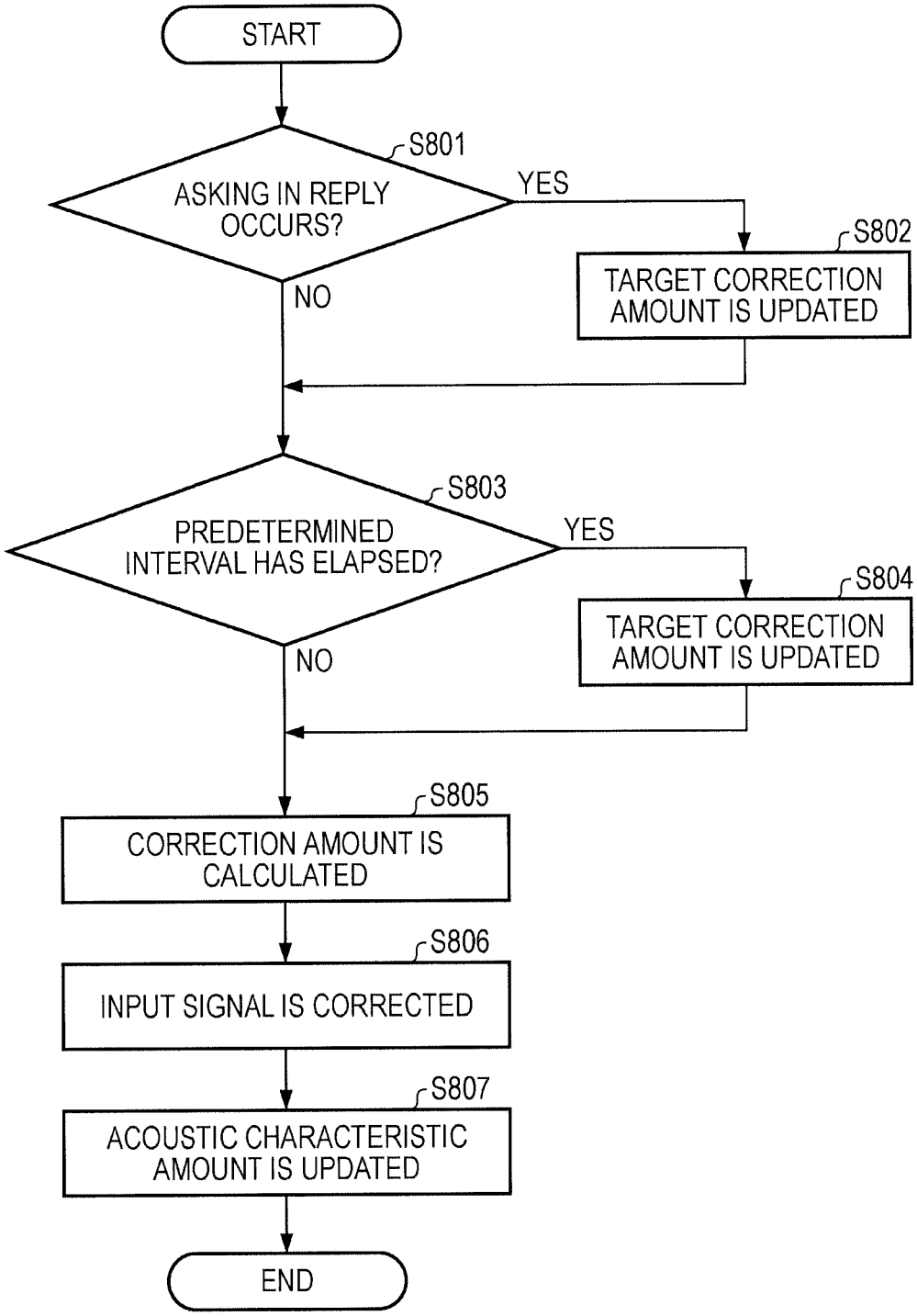
FIG. 31 is a flowchart illustrating an example of voice correction processing in the seventh embodiment.

Next, the operation of the voice correction device 70 in the seventh embodiment will be described. FIG. 31 is a flowchart illustrating an example of voice correction processing in the seventh embodiment. In Step S801 illustrated in FIG. 31, the target correction amount update unit 702 determines whether or not the detection of asking in reply has occurred. When the detection of asking in reply has occurred (Step S801: YES), the processing proceeds to Step S802, and when the detection of asking in reply has not occurred (Step S801: NO), the processing proceeds to Step S803.

In Step S802, the target correction amount update unit 702 adds a penalty to intelligibility for the data set of individual current acoustic characteristic amounts, and updates a target correction amount.

In Step S803, the target correction amount update unit 702 determines whether or not a frame number is a multiple of an update interval (for example, several seconds). When the frame number is a multiple of an update interval (Step S803: YES), the processing proceeds to Step S804, and when the frame number is not a multiple of an update interval (Step S803: NO), the processing proceeds to Step S805.

In Step S804, the target correction amount update unit 702 adds a score to intelligibility for the data set of the individual current acoustic characteristic amounts, and updates the target correction amount.

In Step S805, the correction control unit 704 compares a target correction amount for a current fundamental frequency with a current speaking speed, and calculates a correction amount.

In Step S806, the correction unit 705 converts the speaking speed of an input sound in accordance with the correction amount calculated in Step S805.

In Step S807, the target correction amount update unit 702 updates the speaking speed and the fundamental frequency after the correction of the current frame, calculated in the characteristic amount calculation unit 701. In this regard, however, when, in the characteristic amount calculation unit 701, it is determined that the current frame of the input sound is not a voice, the target correction amount update unit 702 performs control so that the update is not performed.

As described above, according to the seventh embodiment, while just naturally having a conversation, it is possible to cause a voice to be easily heard in conformity to the audibility characteristic of the user and the vocal sound of the other. Here, when the speaking speed is fast, a brain tends to concentrate on the conversation so as to understand the conversation. Therefore, response means causing distracting from the conversation to be necessary may be hard to use. Accordingly, since no occurs response from the user even if the conversation is hard to hear, the absence of a user response occurs and erroneous learning occurs.

Therefore, in the seventh embodiment, asking in reply in a conversation is used as a user response, and hence it is possible to learn, with a high degree of accuracy, a state in which it is hard for the user concentrating on the conversation to hear.

In addition, in the fifth to seventh embodiments, the configurations have been described that do not include the analysis unit described in the first to fourth embodiments. However, the fifth to seventh embodiments may include the analysis unit, and when a user response has occurred, the analysis unit may cause an acoustic characteristic amount, acquired from the characteristic amount calculation unit and buffered, to be stored in the storage unit.

Figure 32:
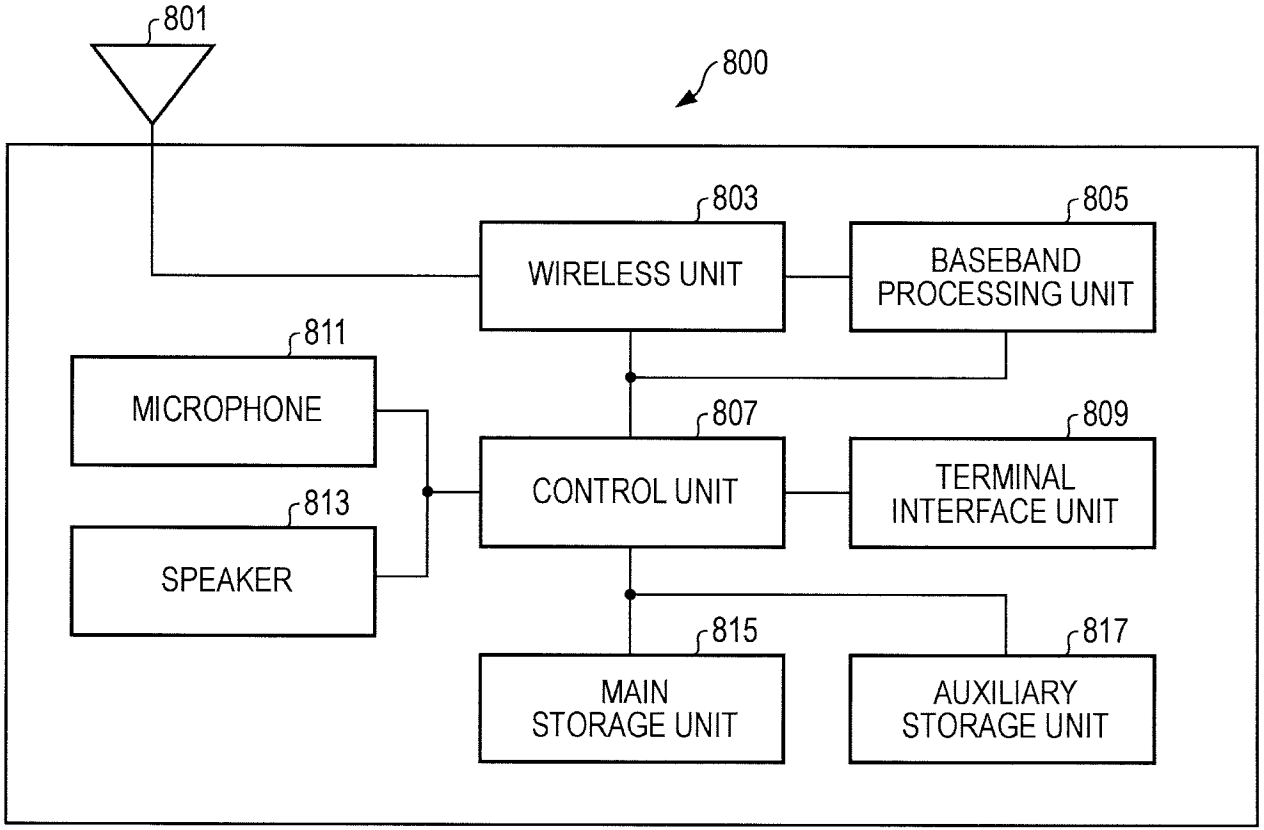
FIG. 32 is a block diagram illustrating an example of hardware of a mobile terminal device.

Next, the hardware of a mobile terminal device will be described that includes the voice correction device or the voice correction unit, described in the individual embodiments. FIG. 32 is a block diagram illustrating an example of the hardware of a mobile terminal device 800. The mobile terminal device 800 illustrated in FIG. 32 includes an antenna 801, a wireless unit 803, a baseband processing unit 805, a control unit 807, a terminal interface unit 809, a microphone 811, a speaker 813, a main storage unit 815, and an auxiliary storage unit 817.

The antenna 801 transmits a wireless signal amplified in a transmission amplifier, and receives a wireless signal from a base station. The wireless unit 803 D/A-converts a transmission signal spread by the baseband processing unit 805, converts the signal into a high-frequency signal using orthogonal modulation, and amplifies the signal using a power amplifier. The wireless unit 803 amplifies the received wireless signal and A/D-converts and transmits the signal to the baseband processing unit 805.

The baseband unit 805 performs baseband processing operations such as the addition of an error correction code of transmission data, data modulation, spread modulation, the inverse spread of a reception signal, the determination of reception environment, the threshold value determination of each channel, error correction decoding, and the like.

The control unit 807 performs wireless control operations such as the transmission/reception of a control signal and the like. In addition, the control unit 807 executes a voice correction program stored in the auxiliary storage unit 817 or the like, and performs the voice correction processing in each of the above-mentioned embodiments.

The main storage unit 815 is a read only memory (ROM), a random access memory (RAM), or the like, and is a storage device storing or temporarily saving programs such as an OS, which is basic software executed by the control unit 807, application software, and the like, and data.

The auxiliary storage unit 817 is a hard disk drive (HDD) or the like, and is a storage device storing data relating to the application software or the like.

The terminal interface unit 809 performs data-use adapter processing and interface processing between a handset and an external terminal.

Accordingly, in the mobile terminal device 800, in the act of hearing a voice, it is possible to correct a voice so than the voice is easily heard in response to the audibility characteristic of a user, on the basis of a simple operation. In addition, it may be said in each embodiment that a voice becomes more intelligible in response to the audibility characteristic of a user, with the voice correction processing being performed more often.

In addition, the voice correction device or the voice correction unit in each embodiment may be installed, as one semiconductor integrated circuit or a plurality of semiconductor integrated circuits, into the mobile terminal device 800. In addition, the disclosed technique is not limited to the mobile terminal device 800, and may be installed into an information processing terminal outputting a voice.

In addition, a program for realizing the voice correction processing described in each of the above-mentioned embodiments is recorded in a recording medium, and hence it is possible to cause the voice correction processing in each embodiment to be implemented by a computer. For example, this program is recorded in a recording medium, the recording medium in which the program is recorded is caused to be read by a computer or a mobile terminal device, and hence it is also possible to cause the above-mentioned voice correction processing to be realized.

In addition, as the recording medium, various types of recording media may be used that include a recording medium optically, electrically, or magnetically recording information, such as a CD-ROM, a flexible disk, a magnetooptical disk, or the like and a semiconductor memory electrically recording information, such as a ROM, a flash memory, or the like.

In addition, each of the above-mentioned embodiments may also be applicable to a fixed-line phone provided in a call center and the like, in addition to the mobile terminal device.

While, as above, the embodiments have been described, the present embodiments are not limited to the specific embodiments, and various modifications and alterations may occur insofar as they are within the scope of the appended claims. In addition, all or a plurality of the configuration elements of the individual embodiments described above may be combined.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A voice correction device comprising:

a processor; and a memory which stores a plurality of instructions, which when executed by the processor, cause the processor to execute, detecting a response from a user;

calculating a first acoustic characteristic amount of an input voice signal and a second acoustic characteristic amount of an input signal different from the voice signal;

outputting an acoustic characteristic amount of a predetermined amount when having acquired a response signal due to the response from the detecting;

storing input response history information in which the presence or absence of a response detected by the detecting, the first acoustic characteristic amount, and the second acoustic characteristic amount are associated with one another;

extracting input response history information including values corresponding to a value of the first acoustic characteristic amount and a value of the second acoustic characteristic amount, respectively, calculated by the calculating;

calculating a correction amount for the first acoustic characteristic amount on the basis of the extracted input response history information; and correcting the voice signal on the basis of the correction amount.

2. The voice correction device according to claim 1, wherein the plurality of instructions, which when executed by the processor, further cause the processor to execute, calculating a statistic amount of an acoustic characteristic amount when the response signal is not acquired, and calculating the correction amount on the basis of the comparison result and the statistic amount.

3. The voice correction device according to claim 1, wherein the plurality of instructions, which when executed by the processor, further cause the processor to execute, calculating a plurality of different acoustic characteristic amounts, and outputting, to the storage, at least one acoustic characteristic amount from among individual acoustic characteristic amounts selected on the basis of the statistic amount, when having acquired the response signal.

4. The voice correction device according to claim 1, wherein the statistic amount is a frequency distribution, the plurality of instructions, which when executed by the processor, further cause the processor to execute, selecting one acoustic characteristic amount from among a plurality of acoustic characteristic amounts on the basis of a difference between an average value of the frequency distribution and the calculated acoustic characteristic amount, and calculating the correction amount on the basis of the average value.

5. The voice correction device according to claim 4, wherein the plurality of instructions, which when executed by the processor, further cause the processor to execute, calculating the degree of contribution from the average value of the frequency distribution and the calculated acoustic characteristic amount, and outputting an acoustic characteristic amount to the storage unit when the degree of contribution is greater than or equal to a threshold value.

6. The voice correction device according to claim 1, wherein the plurality of instructions, which when executed by the processor, further cause the processor to execute, calculating an acoustic characteristic amount of an input signal different from the voice signal, storing, in the buffer, the acoustic characteristic amount of the voice signal and the acoustic characteristic amount of the input signal, outputting, to the storage, one acoustic characteristic amount selected on the basis of a calculated frequency distribution of each acoustic characteristic amount, when having acquired the response signal from the detector, and calculating the correction amount on the basis of the comparison result of the acoustic characteristic amount selected by the outputting.

7. The voice correction device according to claim 1, wherein the plurality of instructions, which when executed by the processor, further cause the processor to execute, calculating a normal range from an average value of a calculated acoustic characteristic amount and the acoustic characteristic amount stored in the storage, and defines, as the correction amount, a difference between an upper limit or lower limit of the normal range and an acoustic characteristic amount of a current frame.

8. The voice correction device according to claim 1, wherein the acoustic characteristic amount is at least one of a voice level, the slope of spectrum, a speaking speed, a fundamental frequency, a noise level, and an SNR of the voice signal.

9. The voice correction device according to claim 1, wherein the plurality of instructions, which when executed by the processor, further cause the processor to execute, calculating a ratio based on the number of presences of a response and the number of absences of a response, with respect to each value of the first acoustic characteristic amount included in the extracted input response history information, and calculating a correction amount using a value of the first acoustic characteristic amount where the ratio is greater than or equal to a threshold value.

10. The voice correction device according to claim 1, wherein the plurality of instructions, which when executed by the processor, further cause the processor to execute, storing therein a target correction amount indicating a correction amount for the first acoustic characteristic amount, and the voice correction device further includes an update unit updating the target correction amount on the basis of the first acoustic characteristic amount and the second acoustic characteristic amount, calculated by the calculating, and the presence or absence of a response, detected by the detecting.

11. A voice correction device comprising:

a processor; and a memory which stores a plurality of instructions, which when executed by the processor, cause the processor to execute, detecting a response from a user;

calculating an acoustic characteristic amount of an input voice signal;

outputting an acoustic characteristic amount of a predetermined amount when having acquired a response signal due to the response from the detecting;

storing a storage with the acoustic characteristic amount output by the outputting;

controlling a correction amount of the voice signal on the basis of a result of a comparison between the acoustic characteristic amount calculated by the calculating and the acoustic characteristic amount stored in the storage; and correcting the voice signal on the basis of the correction amount calculated by the controlling, wherein the plurality of instructions, which when executed by the processor, further cause the processor to execute, calculating a first acoustic characteristic amount from the voice signal, and at least one or more second acoustic characteristic amounts, storing input response history information in which the presence or absence of a response detected by the detecting, the first acoustic characteristic amount, and the second acoustic characteristic amount are associated with one another, extracting input response history information including values corresponding to a value of the first acoustic characteristic amount and a value of the second acoustic characteristic amount, respectively, calculated by the calculating, and calculating a correction amount for the first acoustic characteristic amount on the basis of the extracted input response history information.

12. The voice correction device according to claim 11, wherein the plurality of instructions, which when executed by the processor, further cause the processor to execute, calculating the first acoustic characteristic amount and the second acoustic characteristic amount for a voice signal corrected by the correction unit, and the storage unit stores therein the first acoustic characteristic amount and the second acoustic characteristic amount of the corrected voice signal.

13. A voice correction method due to a voice correction device, comprising:

calculating a first acoustic characteristic amount of an input voice signal and a second acoustic characteristic amount of an input signal different from the voice signal;

detecting a response from a user;

buffering the calculated acoustic characteristic amount, and outputting an acoustic characteristic amount of a predetermined amount when a response signal due to the detected response has been acquired;

storing input response history information in which the presence or absence of a response detected by the detecting, the first acoustic characteristic amount, and the second acoustic characteristic amount are associated with one another;

extracting input response history information including values corresponding to a value of the first acoustic characteristic amount and a value of the second acoustic characteristic amount, respectively, calculated by the calculating;

calculating a correction amount for the first acoustic characteristic amount on the basis of the extracted input response history information; and correcting the voice signal on the basis of the calculated correction amount.

14. A non-transitory static recording medium recording a program causing a voice correction device to perform a voice correction processing, the program causing the voice correction device to perform the following processing comprising:

calculating a first acoustic characteristic amount of an input voice signal and a second acoustic characteristic amount of an input signal different from the voice signal;

detecting a response from a user;

buffering the calculated acoustic characteristic amount, and outputting an acoustic characteristic amount of a predetermined amount when a response signal due to the detected response has been acquired;

storing input response history information in which the presence or absence of a response detected by the detecting, the first acoustic characteristic amount, and the second acoustic characteristic amount are associated with one another;

extracting input response history information including values corresponding to a value of the first acoustic characteristic amount and a value of the second acoustic characteristic amount, respectively, calculated by the calculating;

calculating a correction amount for the first acoustic characteristic amount on the basis of the extracted input response history information; and correcting the voice signal on the basis of the calculated correction amount.

* * * * *